US011457762B2

(12) United States Patent
Wexler et al.

(10) Patent No.: US 11,457,762 B2
(45) **Date of Patent: *Oct. 4, 2022**

(54) HANGABLE APPARATUS AND SYSTEMS AND METHODS THEREFOR

(71) Applicant: Medline Industries, LP, Northfield, IL (US)

(72) Inventors: Paige Wexler, Highland Park, IL (US); Joshua Bobo, Round Lake, IL (US); John Piazzi, Chicago, IL (US)

(73) Assignee: Medline Industries, LP, Northfield, IL (US)

( * ) Notice: Subject to any disclaimer, the term of this patent is extended or adjusted under 35 U.S.C. 154(b) by 23 days.

This patent is subject to a terminal disclaimer.

(21) Appl. No.: 17/195,464

(22) Filed: Mar. 8, 2021

(65) Prior Publication Data

US 2021/0186248 A1 Jun. 24, 2021

Related U.S. Application Data

(63) Continuation of application No. 16/588,771, filed on Sep. 30, 2019, now Pat. No. 10,945,548, which is a continuation-in-part of application No. 16/045,391, filed on Jul. 25, 2018, now Pat. No. 10,799,055.

(51) Int. Cl.

| | |
|---|---|
| ***A47H 1/14*** | (2006.01) |
| ***A47H 1/142*** | (2006.01) |
| ***A47H 1/144*** | (2006.01) |
| ***A47H 1/104*** | (2006.01) |
| ***A47H 1/04*** | (2006.01) |

(52) U.S. Cl.

CPC ..... *A47H 1/14* (2013.01); *A47H 1/104* (2013.01); *A47H 1/142* (2013.01); *A47H 1/144* (2013.01); *A47H 1/04* (2013.01)

(58) Field of Classification Search

CPC ..... A47H 1/102; A47H 1/104; A47H 1/14; A47H 1/142; A47H 1/144; A47H 1/04

USPC ..... 16/87.2, 94 R, 94 D

See application file for complete search history.

(56) References Cited

U.S. PATENT DOCUMENTS

| | | | | |
|---|---|---|---|---|
| 443,981 A | | 12/1890 | Braren | |
| 2,837,804 A | | 6/1958 | Danell | |
| 2,979,760 A | | 4/1961 | Sladky | |
| 3,192,994 A | * | 7/1965 | Graber, V | A47H 1/142 160/126 |
| 3,688,717 A | | 9/1972 | Rudolph et al. | |
| 3,881,218 A | | 5/1975 | Palmer | |
| 3,989,283 A | | 11/1976 | Pepper | |
| 4,031,943 A | | 6/1977 | Silvestre | |
| 4,190,927 A | | 3/1980 | Hepperle | |

(Continued)

OTHER PUBLICATIONS

Obrien, Jeffrey , "Notice of Allowance", U.S. Appl. No. 16/913,815, filed Jun. 26, 2020; dated Dec. 8, 2021.

(Continued)

*Primary Examiner* — Jeffrey O'Brien
(74) *Attorney, Agent, or Firm* — Philip H. Burrus, IV

(57) ABSTRACT

A track hanger (100) includes a hook (103) and an extension (104), a base member (102), and a key (403). The key is detachable from the hook, and the base member is detachable from the extension. The key can include a first major surface (401) and a second major surface (402). The first major surface can define one or more barbs (404) that facilitate one-way insertion of the key into a track (106).

20 Claims, 22 Drawing Sheets

(56) References Cited

U.S. PATENT DOCUMENTS

| | | | | |
|---|---|---|---|---|
| 4,228,738 | A * | 10/1980 | Forshee | B61B 12/02 248/548 |
| 4,228,980 | A * | 10/1980 | Beauchamp | A47H 23/00 5/493 |
| 4,229,857 | A | 10/1980 | Toder | |
| 5,186,232 | A | 2/1993 | Zahner | |
| 5,335,890 | A * | 8/1994 | Pryor | A47H 15/02 248/343 |
| 5,586,375 | A | 12/1996 | Cooperman et al. | |
| 5,586,595 | A | 12/1996 | Takizawa et al. | |
| 5,598,785 | A * | 2/1997 | Zaguroli, Jr. | B66C 7/04 104/111 |
| 5,615,461 | A | 4/1997 | Tominaga et al. | |
| 6,189,597 | B1 | 2/2001 | Cheng | |
| 6,223,389 | B1 | 5/2001 | Walsh et al. | |
| 6,382,297 | B1 | 5/2002 | Takizawa | |
| 6,494,248 | B1 | 12/2002 | Zahner | |
| 6,530,120 | B2 | 3/2003 | Samelson | |
| D472,795 | S | 4/2003 | Saxby | |
| 6,698,061 | B2 | 3/2004 | Ho | |
| 6,866,082 | B1 | 3/2005 | Zahner | |
| 6,935,402 | B2 | 8/2005 | Zahner | |
| 7,003,848 | B2 * | 2/2006 | Ho | A47K 3/38 16/87.8 |
| D551,950 | S | 10/2007 | Davenpor | |
| 7,296,609 | B2 | 11/2007 | Zahner | |
| 7,523,778 | B2 | 4/2009 | Roberts et al. | |
| 7,698,781 | B2 | 4/2010 | Cai | |
| 7,757,347 | B1 | 7/2010 | Wiker | |
| 7,788,769 | B2 | 9/2010 | Wiker et al. | |
| 8,118,078 | B2 * | 2/2012 | Freedland | A47H 13/04 16/87.2 |
| 8,151,385 | B2 | 4/2012 | Goskowski et al. | |
| 8,235,088 | B2 | 8/2012 | Zahner | |
| D668,091 | S | 10/2012 | Zahner | |
| D669,721 | S | 10/2012 | Zahner | |
| 8,307,499 | B2 * | 11/2012 | Ruffo | A47H 13/00 160/178.1 V |
| 8,408,275 | B2 * | 4/2013 | DeWees | A47H 1/08 160/340 |
| 8,719,974 | B2 | 5/2014 | Empey | |
| 9,022,333 | B2 * | 5/2015 | Chen | F16B 5/0621 248/343 |
| D746,078 | S | 12/2015 | Zahner | |
| 9,572,447 | B2 | 2/2017 | Pierce | |
| 9,861,222 | B2 * | 1/2018 | Bauer | A47H 13/04 |
| 10,045,649 | B2 | 8/2018 | Zahner | |
| 10,085,582 | B2 * | 10/2018 | Zahner | A47H 13/02 |
| 10,264,908 | B2 * | 4/2019 | Hatton | A47H 15/04 |
| 2,652,586 | A1 | 1/2020 | Ramsberger | |
| 10,568,450 | B2 | 2/2020 | James et al. | |
| 10,758,072 | B2 | 9/2020 | Hatton et al. | |
| 10,799,055 | B2 * | 10/2020 | McNabb | A47H 1/14 |
| D909,189 | S | 2/2021 | Muller | |
| 10,945,548 | B2 * | 3/2021 | Wexler | A47H 1/144 |
| 2003/0012924 | A1 | 1/2003 | Samelson | |
| 2003/0172502 | A1 | 9/2003 | Ho | |
| 2005/0022950 | A1 | 2/2005 | Putman | |
| 2006/0037721 | A1 | 2/2006 | Zahner | |
| 2006/0266483 | A1 | 11/2006 | Roberts et al. | |
| 2008/0164393 | A1 | 7/2008 | Hung | |
| 2008/0178423 | A1 | 7/2008 | Patel | |
| 2008/0202710 | A1 | 8/2008 | Zahner | |
| 2009/0032659 | A1 * | 2/2009 | Goldstein | A47H 13/01 248/220.21 |
| 2009/0288783 | A1 | 11/2009 | Graneto, III | |
| 2009/0288784 | A1 | 11/2009 | Graneto, III | |
| 2009/0288785 | A1 | 11/2009 | Graneto, III | |
| 2010/0212845 | A1 | 8/2010 | Graneto, III et al. | |
| 2010/0282420 | A1 | 11/2010 | Lai | |
| 2010/0319858 | A1 | 12/2010 | Freedland | |
| 2010/0325836 | A1 | 12/2010 | Lai | |
| 2011/0000051 | A1 * | 1/2011 | Liang | A47K 3/38 16/94 R |
| 2011/0225774 | A1 | 9/2011 | Seddon | |
| 2011/0297632 | A1 | 12/2011 | Goldstein | |
| 2012/0000616 | A1 * | 1/2012 | DeWees | A47H 1/18 160/330 |
| 2012/0018106 | A1 * | 1/2012 | Robledo | A47H 1/04 160/330 |
| 2013/0019395 | A1 | 1/2013 | Pierce | |
| 2013/0025341 | A1 | 1/2013 | Ciprich et al. | |
| 2013/0145543 | A1 | 6/2013 | Cattandino et al. | |
| 2014/0000821 | A1 * | 1/2014 | DeWees | A47H 13/02 160/330 |
| 2015/0007950 | A1 | 1/2015 | Ho | |
| 2015/0068688 | A1 | 3/2015 | Zahner | |
| 2015/0136339 | A1 * | 5/2015 | Bauer | A47H 1/142 248/342 |
| 2015/0173549 | A1 * | 6/2015 | Zahner | A47H 1/144 160/330 |
| 2016/0367060 | A1 * | 12/2016 | Zahner | A47H 1/144 |
| 2017/0314607 | A1 * | 11/2017 | Bauer | A47H 1/18 |
| 2018/0177321 | A1 | 6/2018 | Heidsiek | |
| 2018/0296018 | A1 | 10/2018 | Baines et al. | |
| 2020/0300288 | A1 * | 9/2020 | Bauer | A47H 1/18 |

OTHER PUBLICATIONS

Obrien, Jeffrey D., "Notice of Allowance", U.S. Appl. No. 17/066,123, filed Oct. 8, 2013; dated Jun. 29, 2021.

O'Brien, Jeffrey, "Notice of Allowance", U.S. Appl. No. 16/045,391, filed Jul. 25, 2018; dated May 28, 2020.

O'Brien, Jeffrey, "Notice of Allowance", U.S. Appl. No. 16/588,771, filed Sep. 30, 2019; dated Nov. 12, 2020.

* cited by examiner

HANGABLE APPARATUS AND SYSTEMS AND METHODS THEREFOR

CROSS REFERENCE TO PRIOR APPLICATIONS

This application is a continuation application claiming priority and benefit under 35 U.S.C. § 120 from U.S. application Ser. No. 16/588,771, filed Sep. 30, 2019, which is a continuation-in-part application claiming priority and benefit under 35 U.S.C. § 120 from U.S. application Ser. No. 16/045,391, filed Jul. 25, 2018, each of which is incorporated by reference for all purposes.

BACKGROUND

Technical Field

This disclosure relates generally to hangable devices, and more particularly to an items comprising a hanger that hangs from a rail or track.

Background Art

Hanging items are popular in homes and businesses. Hanging items include curtains, drapes, plants, art, and so forth. Hanging items typically include a hanger, a mount, and something suspended from the hanger. Using a plant as one example, the hanger may comprise a metal hook, with the plant suspended beneath the hook. A user may couple the hook to a loop, perhaps mounted on the ceiling, to hang the plant.

While there are a variety of types of hangers and types of hanging items, curtains provide special challenges for designers. This is especially true in medical or hospital environments. It is frequently the case that medical service providers employ curtains to separate patients, conceal medical procedures from view, and to segregate areas of operating rooms and care centers. It is advantageous to launder such curtains to prevent the curtains from acting as a vector to transfer pathogens and bacteria from one patient to the next. Even where the curtains are disposable, they still need to be changed to prevent transfer of pathogens and bacteria from one patient to the next. However, prior art curtains are difficult to take down and clean due to the fact that they are frequently attached to carriers that slide within a metal track. The dismounting process is costly and labor intensive.

It would be advantageous to have an improved hangable apparatus, suitable for use in curtain and drape systems, which is easier and quieter to dismount.

Figure 1:
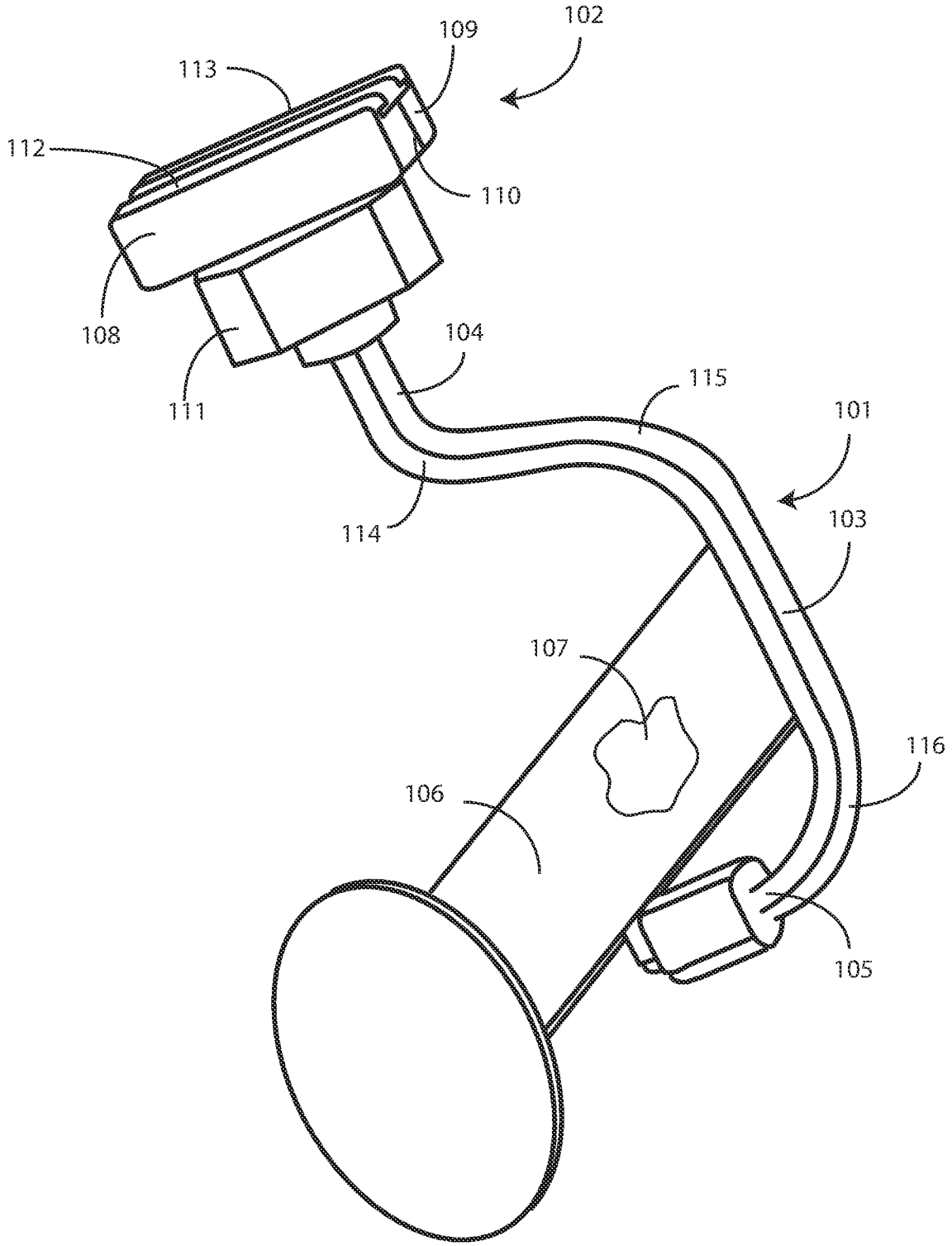
FIG. 1 illustrates a perspective view of one explanatory track hanger system in accordance with one or more embodiments of the disclosure.

Skilled artisans will appreciate that elements in the figures are illustrated for simplicity and clarity and have not necessarily been drawn to scale. For example, the dimensions of some of the elements in the figures may be exaggerated relative to other elements to help to improve understanding of embodiments of the present disclosure.

DETAILED DESCRIPTION OF THE DRAWINGS

Embodiments of the disclosure are now described in detail. Referring to the drawings, like numbers indicate like parts throughout the views. Apparatus components and method steps have been represented where appropriate by conventional symbols in the drawings, showing only those specific details that are pertinent to understanding the embodiments of the present disclosure so as not to obscure the disclosure with details that will be readily apparent to those of ordinary skill in the art having the benefit of the description herein.

As used in the description herein and throughout the claims, the following terms take the meanings explicitly associated herein, unless the context clearly dictates otherwise: the meaning of "a," "an," and "the" includes plural reference, the meaning of "in" includes "in" and "on." Relational terms such as first and second, top and bottom, and the like may be used solely to distinguish one entity or action from another entity or action without necessarily requiring or implying any actual such relationship or order between such entities or actions. The terms "substantially" and "about" are used to refer to dimensions, orientations, or alignments inclusive of manufacturing tolerances. Thus, a "substantially orthogonal" angle with a manufacturing tolerance of plus or minus two degrees would include all angles between 88 and 92, inclusive. Also, reference designators shown herein in parenthesis indicate components shown in a figure other than the one in discussion. For example, talking about a device (10) while discussing figure A would refer to an element, 10, shown in figure other than figure A.

Embodiments of the disclosure provide a track hanger system for an item. In one embodiment, the item to be hung is a curtain. Illustrating by example, for a hospital setting where infection control is an area of high concern, track hangers configured in accordance with embodiments of the disclosure can be used to hang curtains between patients, procedures, areas, and so forth. Track hangers configured in accordance with embodiments of the disclosure are easier to mount and dismount than are prior art designs. Accordingly, embodiments of the disclosure advantageously make it easier for health care practitioners to change and launder the curtains to ensure that bacteria and other pathogens are not readily transferred from patient to patient or from patient to health care practitioner.

Embodiments of the disclosure contemplate that it is very difficult to change prior art curtain systems designed for health care environments. The hangers are difficult to dismount. Additionally, a technician, and sometimes multiple people, equipped with ladders or specialized equipment are required to dismount the curtains, making changing or laundering the curtains a labor-intensive and costly endeavor. For this reason, curtains are rarely changed or washed. In some situations, it is considered fortunate if the curtains were changed three times a year.

Advantageously, embodiments of the disclosure offer an improved track hanger that is easier to mount to a tiled ceiling, e.g., a dropped ceiling that includes a suspension grid of metal channels or rails, which are suspended to support ceiling panels, as are found in most hospitals, doctor's offices, and other health care offices. In one or more embodiments, the track hanger includes a hook, an extension, a head, a base member, and a key. Each component can be modular and detachable from the other. For example, the key can be detachable from the hook. Similarly, the base member can be detachable from the extension, and so forth.

In one or more embodiments, the key includes a first major surface and a second major surface. One or both of the first major surface or the second major surface can define one or more barbs that facilitate a one-way insertion of the key into the track. This makes the track hangers and track extremely quick to mount.

Once mounted, curtains can be hung from the track. These curtains, such as those described in commonly assigned U.S. Ser. No. 15/651,774, filed Jul. 17, 2017, which is incorporated herein by reference, are quick and simple to mount and dismount. They require only a single person—working for a few minutes—to change the curtains. Accordingly, embodiments of the disclosure allow for more frequent changing and laundering of curtains, thereby promoting health and safety when used in hospitals or other health care settings.

In addition to potentially serving as vectors for bacteria and other pathogens, prior art curtain hanging systems have other problems as well. Most hangers require special mounting hardware and/or tools to mount to a wall or ceiling. Additionally, the mounting hardware leaves scars in the wall or ceiling should the hanger ever be taken down. Embodiments of the disclosure provide a solution to each of these problems by providing a base member that includes a first base member portion and a second base member portion. The first base member portion and the second base member portion are separable from each other along a medial major axis of the base member.

In one or more embodiments, the first base member portion comprises a first half rail clamp. Similarly, the second base member portion can include a second half rail clamp. In one or more embodiments, the first half rail clamp defines a first half head-receiving aperture, while the second half rail clamp defines a second half head-receiving aperture. In one or more embodiments, coupling the first base member portion to the second base member portion causes the first half head-receiving aperture to abut the second half head-receiving aperture, thereby resulting in the base member defining a head-receiving aperture into which the head of the hanger may situate.

In one or more embodiments, the hanger is then coupled to the base member. In one or more embodiments, the hanger includes a head, which is coupled to the extension. In one or more embodiments, the extension is situated between the head and the hook. In one or more embodiments, the head of the hanger is locked into the head-receiving aperture of the base member such that it is able to "clamp" onto a rail passing through the base member.

In one or more embodiments, separating the first base member portion from the second base member portion along the medial major axis therefore separates the first half rail clamp from the second half rail clamp and splits the head-receiving aperture. When used with a drop ceiling having a suspension grid of rails, one can simply place the first rail half clamp to the left of a rail and the second rail half clamp to the right of the rail, or vice versa.

The first base member portion can then be pressed against the second base member portion along the medial major axis, which causes the rail of the suspension grid to be caught between the first half rail clamp and the second half rail clamp. The head of the hanger can then be situated within the head-receiving aperture. A fastener can then be attached to the base member to both retain the first base member portion against the second base member portion and to clamp the head of the hanger against the rail. The fastener can be coupled and uncoupled as desired so as to allow quick and easy coupling of the base member and head of the hanger to the rails of the suspension grid.

In one or more embodiments, the coupler engages one or more threads disposed on the exterior surface of a head receiver extending distally from the base member to retain the first base member portion against the second base member portion and the head of the hanger against the rail through the head-receiving aperture. As will be shown in more detail below, the coupler can also be used to bias and claim the head, which is attached to the extension and hook, against a major face of the rail within an interior socket supporting the threads. Thus, in one or more embodiments, the rail is clamped on three sides—two by the first base member portion and the second base member portion, and a third by the head of the hanger against the major surface of the rail. Advantageously, a track hanger for an item comprises a uniquely configured base member that facilitates simple mounting and dismounting of the track hanger to a rail of a conventional suspension grid of a drop ceiling while also biasing the head of a hanger against the same rail for additional coupling power.

Turning now to FIGS. 1-4, illustrated therein is one explanatory embodiment of a track hanger 100 configured in accordance with one or more embodiments of the disclosure. In one embodiment, the track hanger 100 is to suspend a track from a surface such as a wall or ceiling.

The track hanger 100, in one or more embodiments, includes a hanger 101, a base member 102, and a key 403. In one or more embodiments, each of the hanger 101, the base member 102, and the key 403 are separable from each other. For example, in one embodiment the hanger 101 can be detached from the base member 102. Similarly, the key 403 can be detached from the hanger 101. It should be noted that the track hanger 100 can be manufactured in different sizes and shapes so as to be compatible with, and fit appropriately, differently sized suspension grids of drop ceilings.

In one or more embodiments, the hanger 101 comprises a hook 103 and an extension 104. In one or more embodiments, the key 403 attaches to a distal end 105 of the hook 103. Accordingly, where the key 403 is detachable from the hanger 101, the attachment location to attach or detach the key 403 from the hook 103 is the distal end 105. Thus, in one or more embodiments the key 403 is detachable from the hook 103.

In one embodiment, the hanger 101 is configured as a single, unitary element. Said differently, in one embodiment the hook 103 and the extension 104 are manufactured as a single, integral unit. As will be described in more detail below with reference to FIG. 7, the hanger 101 can also include a head. Where included, the hook 103, the extension 104, and the head can be manufactured as a single, integral unit.

Illustrating by example, in one embodiment the hook 103, the extension 104, and the head are manufactured from a thermoplastic material by way of an injection molding process. The hook 103, the extension 104, and the head can be manufactured from nylon, styrene, ABS, polycarbonate, or polycarbonate-ABS, PMMA, PVC, or other polyamide-based thermoplastics in one embodiment. Other materials suitable for manufacturing the hook 103, the extension 104, and the head will be obvious to those of ordinary skill in the art having the benefit of this disclosure. While the base member 102 and the key 403 are separable from the hanger 101, in one or more embodiments the base member 102 and the key 403 can be manufactured from the same material as is the hanger 101. In other embodiments, the hanger 101 is manufactured from materials different from the base member 102 and/or key 403. The base member 102, hanger 101, and key 403 can each be manufactured from different materials as well.

Figure 4:
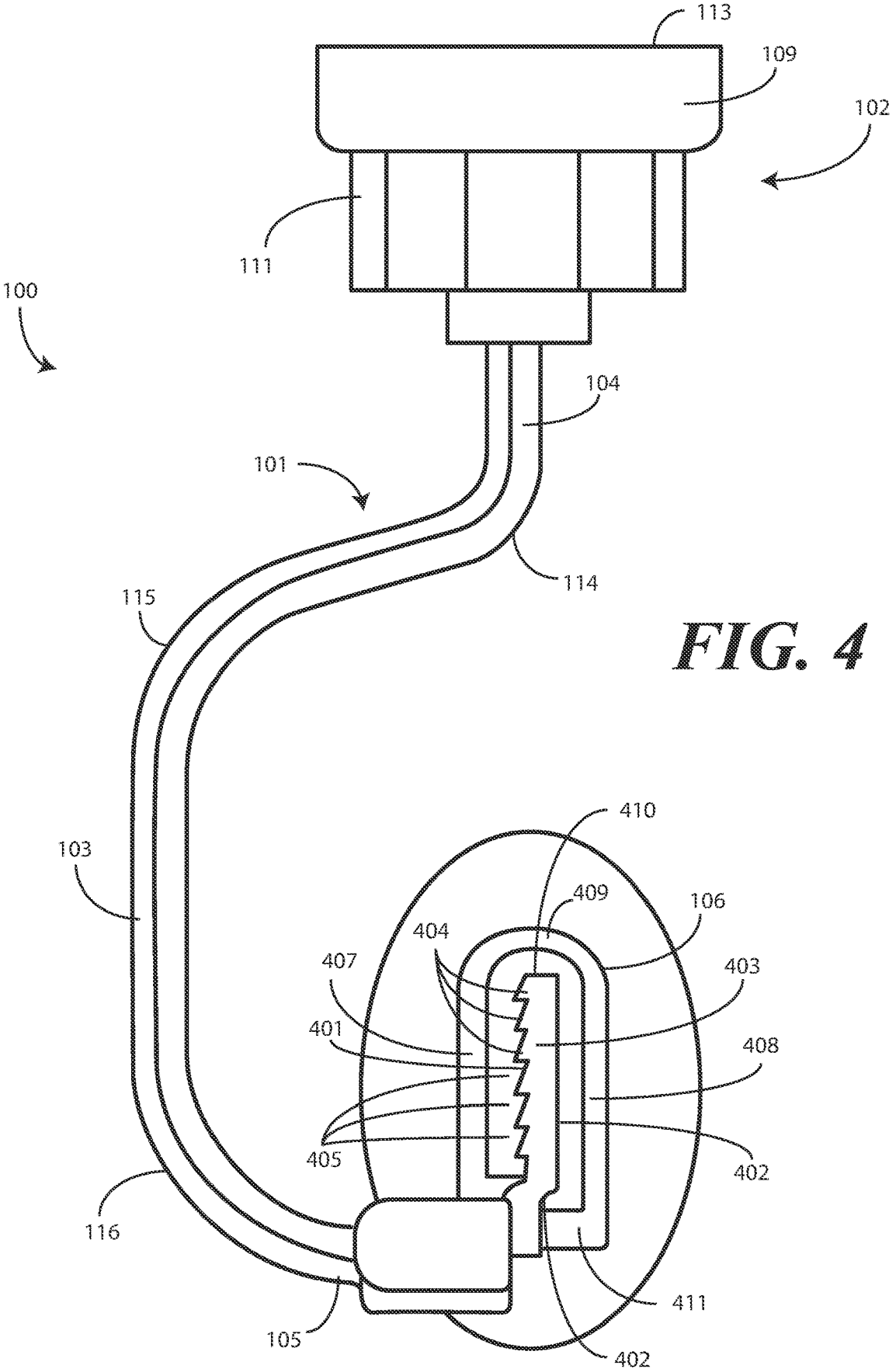
FIG. 4 illustrates a side elevation view of one explanatory track hanger in accordance with one or more embodiments of the disclosure.

As best seen in FIG. 4, in one embodiment the key 403 includes a first major surface 401 and a second major surface 402. In this illustrative embodiment, the first major surface 401 defines one or more barbs 404. Each barb comprises a hemi-triangular protrusion with the base of each hemi-triangular protrusion being disposed beneath the side of the hemi-triangular protrusion. In this illustrative embodiment, the second major surface 402 is substantially planar.

In one or more embodiments, a track 106 attaches to the key 403. In this illustrative embodiment, the track 106 has a first flat side 407 and a second flat side 408. An arch 409 spans between ends of the first flat side 407 and the second flat side 408 in this embodiment.

In one embodiment, the track 106 is flexible so that it can be shaped into different contours when attached to a track hanger 100. For example, in one embodiment the track 106 is manufactured from plastic. One suitable plastic for the track 106 is polypropylene, although other flexible materials, such as polyethylene, will be obvious to those of ordinary skill in the art having the benefit of this disclosure. Additionally, other material such as ABS plastic can be used in other embodiments. In one embodiment, the track 106 is manufactured from an extrusion process.

In one embodiment, the track 106 is a continuous piece. In other embodiments, segments of different tracks can be aligned end-to-end to form a composite track. In one embodiment, the track 106 is malleable. While the cross section of the track 106 shown in FIG. 4 is generally flat along each of the first flat side 407 and the second flat side 408, it should be noted that the cross section could take other shapes as well, such as ovular or flat.

In one embodiment the track 106 is configured so as to be easily cleanable. In one embodiment, the track 106 is manufactured so as to be light beige in color. In another embodiment, the track 106 is manufactured so as to be white in color. Other colors for the track 106 will be obvious to those of ordinary skill in the art having the benefit of this disclosure. In one embodiment, the track 106 is cut to predefined lengths, such as twenty-foot lengths. In one or more embodiments, the ends of the track 106 can be contoured for smooth interconnection to adjacent track segments.

In one embodiment, the track 106 comprises a coating 107. For example, in one embodiment the track 106 is coated with a silicon-based coating to allow curtains or other hangers to more smoothly slide along the track 106. It should be noted that one primary advantage offered by embodiments of the disclosure is that hanging systems configured in accordance with embodiments of the disclosure are very, very quiet when in operation. For example, where the track 106 is manufactured from polyethylene and coated with silicon, and a curtain having a hanger such as those described in commonly assigned U.S. Ser. No. 15/651,774, filed Jul. 17, 2017, which is incorporated herein by reference, which is made from a woven polyester mesh, moving the hanger along the track 106 is nearly a silent procedure. This is advantageous in hospitals and other medical environments where noise is problematic. Prior art hanging systems, which primarily include metal, are loud and intrusive. In one embodiment of the present disclosure, each of the track 106, the hanger, and any item attached thereto is made without any metal. This greatly reduces—if not eliminates—noise when the hangers are moved on the track 106.

A second advantage of not including metal in either the track 106 or items hanging therefrom is that components of systems configured in accordance with various embodiments of the disclosure can be extremely light in weight. This enables the track 106 to easily be mounted on the key 403. The process can be accomplished by anyone, regardless of size or strength.

The inclusion of the first flat side 407, the second flat side 408, and the arch 409 define a peninsular indentation 410 into which the key 403 may be inserted. In this illustrative embodiment, the track 106 comprises one or more complementary barbs 405. Each of the one or more complementary barbs 405 is complementary in shape to the one or more barbs 404 of the key 403. Here, each complementary barb comprises an inverted hemi-triangular protrusion with a base of each inverted hemi-triangular protrusion being disposed above a side of the inverted hemi-triangular protrusion.

Using this configuration, the one or more barbs 404 of the key 403 facilitate one-way penetration of the key 403 into the track 106. In one or more embodiments, the track 106 is manufactured from a pliable material, such as a thermoplastic. When the key 403 is inserted into the peninsular indentation 410, the first flat side 407 of the track 106 flexes so that the one or more complementary barbs 405 of the track 106 pass over the one or more barbs 404 of the key 403. Once the key 403 is fully inserted into the peninsular indentation 410 of the track 106, first flat side 407 of the track 106 flex back toward the key 403, thereby causing the one or more complementary barbs 405 to engage the one or more barbs 404 of the key 403. This results in the key 403 being frictionally retained within the track 106.

In one or more embodiments, the second flat side 408 of the track 106 terminates at an end opposite the arch 409 in an L-shaped latch 411. In one or more embodiments, the second major surface 402 of the key includes a complementary L-shaped indention 412 into which the base of the "L" of the L-shaped latch 411 seats when the key 403 is fully inserted into the track 106.

In operation, when the key 403 is inserted into the peninsular indentation 410, the second flat side 408 of the track 106 flexes so the base of the "L" of the L-shaped latch 411 of the track 106 can pass over the second flat side 408 of the key 403. Once the key 403 is fully inserted into the peninsular indentation 410 of the track 106, second flat side 408 of the track 106 flexes back toward the key 403, thereby causing the base of the "L" of the L-shaped latch 411 to seat within the complementary L-shaped indention 412 of the key 403. This assists in retaining the key 403 within the track 106.

In one or more embodiments, the base member 102 comprises a first base member portion 108 and a second base member portion 109. In one or more embodiments, the first base member portion 108 and the second base member portion 109 are separable along a medial major axis 110. In the illustrative embodiment of FIGS. 1-4, the first base member portion 108 and the second base member portion 109 have been placed together such that their inner surfaces abut along the medial major axis 110. A coupler 111, which in this embodiment is a plastic hex nut, couples the first base member portion 108 and the second base member portion 109 together to retain the inner surfaces abutting at the medial major axis 110.

Figure 2:
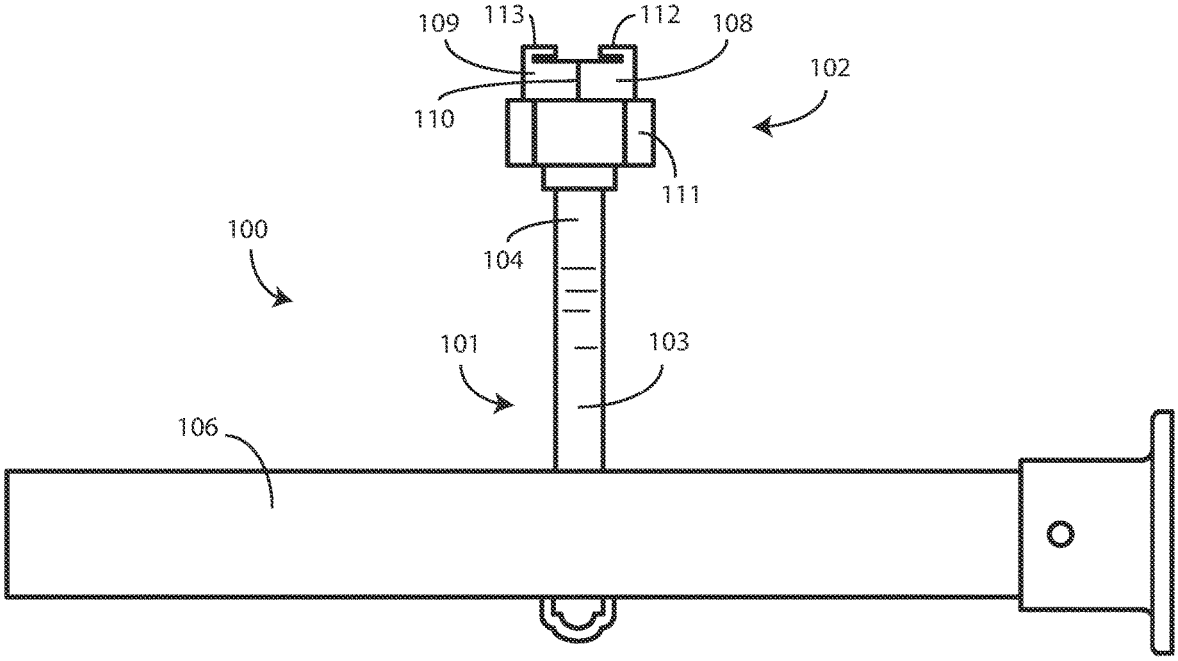
FIG. 2 illustrates a front elevation view of one explanatory track hanger system in accordance with one or more embodiments of the disclosure.
Figure 3:
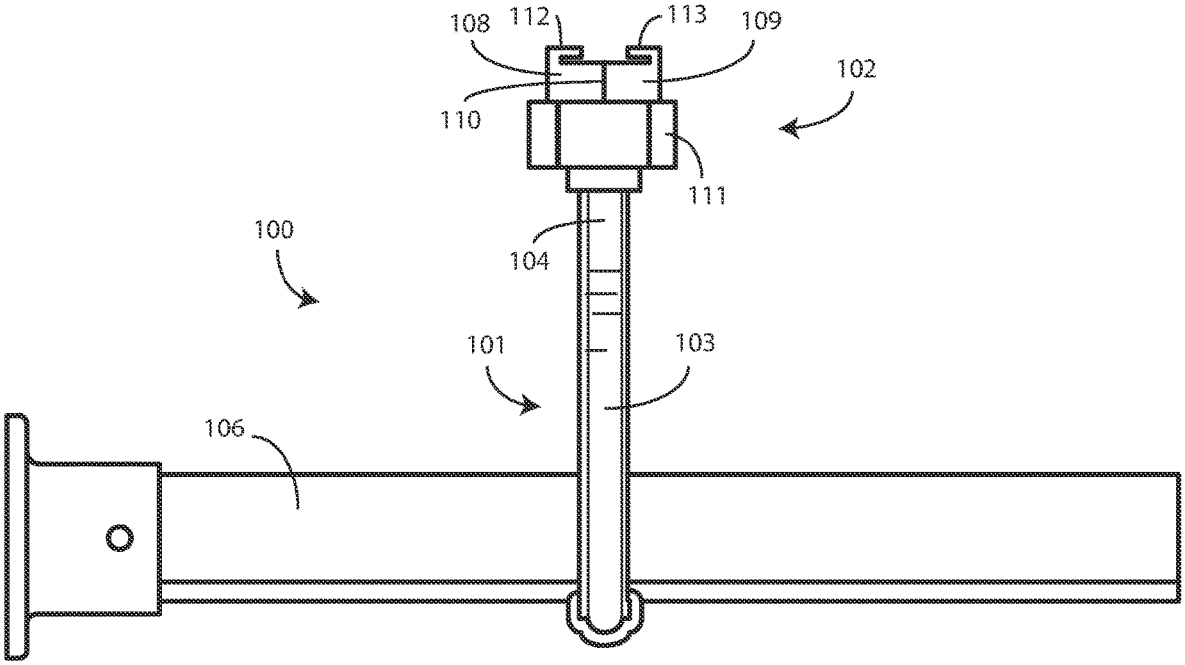
FIG. 3 illustrates a rear elevation view of one explanatory track hanger system in accordance with one or more embodiments of the disclosure.

In one or more embodiments, the first base member portion 108 defines a first half rail clamp 112. Similarly, the second base member portion 109 defines a second half rail clamp 113. Each of the first half rail clamp 112 and the second half rail clamp 113 includes a vertical member extending distally from the first base member portion 108 and the second base member portion 109, respectively, and a horizontal member extending distally from its respective vertical member only a portion of the width of the first base member portion 108 and the second base member portion 109. This leaves a gap between each horizontal member, as shown in FIGS. 2-3. Separating the first base member portion 108 from the second base member portion 109 along the medial major axis 110 therefore separates the first half rail clamp 112 from the second half rail clamp 113. When used with a drop ceiling having a suspension grid of rails, one can simply place the first half rail clamp 112 to the left of a rail and the second half rail clamp 113 to the right of the rail, or vice versa. The first base member portion 108 can then be pressed against the second base member portion 109 along the medial major axis 110. This causes the rail of the suspension grid to be caught between the first half rail clamp 112 and the second half rail clamp 113.

When the coupler 111 is then be attached to the base member 102 to retain the first base member portion 108 against the second base member portion 109, this causes the first half rail clamp 112 from the second half rail clamp 113 to couple the track hanger 100 to the rail of the suspension grid. In one or more embodiments, as will be described below with reference to FIGS. 6-9, the coupler 111 engages one or more threads disposed on the exterior surface of a head receiver extending distally from the base member 102 to retain the first base member portion 108 against the second base member portion 109. As will be also shown in more detail below in these figures, the coupler 111 can also be used to retain a head, which is attached to the extension 104 and hook 103, within an interior socket supporting the threads. Thus, in one or more embodiments, the track hanger 100 comprises a uniquely configured base member 102 that facilitates simple mounting and dismounting of the track hanger 100 to a track of a conventional suspension grid of a drop ceiling.

In the illustrative embodiment of FIGS. 1-4, hanger 101 of the track hanger 100 includes one or more bends 114, 115,116. In this illustrative embodiment, the hanger 101 includes three bends 114,115,116. Bend 114 and bend 115 are obtuse, while bend 116 is substantially orthogonal.

Figure 5:
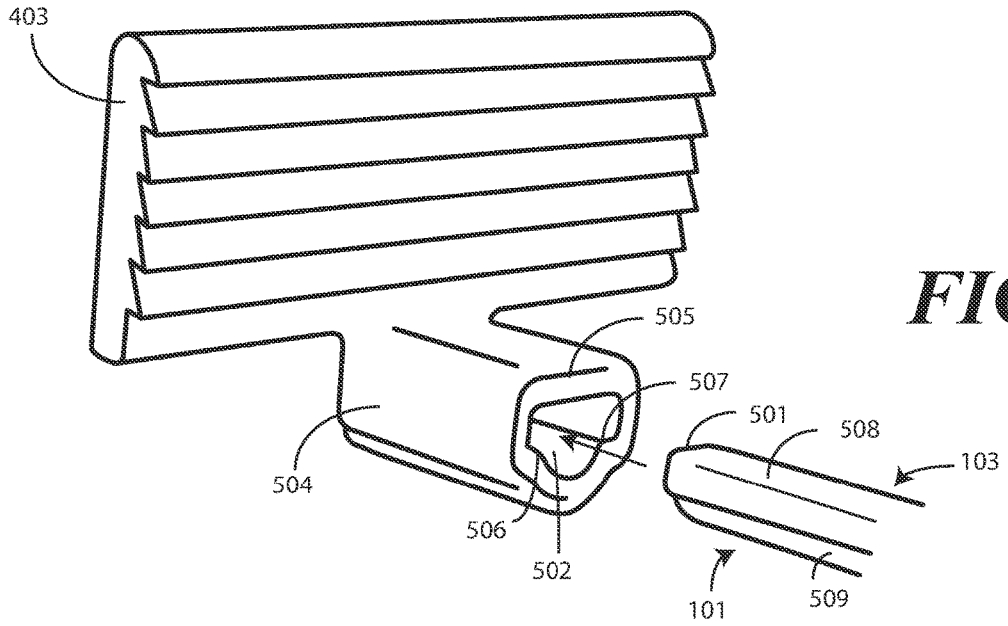
FIG. 5 illustrates one explanatory key and hook tip in accordance with one or more embodiments of the disclosure.

As noted above, in one or more embodiments each of the hanger 101, the base member 102, and the key 403 are separable from each other. For example, in one embodiment the hanger 101 can be detached from the base member 102. Similarly, the key 403 can be detached from the hanger 101. Turning now to FIG. 5, illustrated therein is the key 403 detached from the end 501 of the hook 103. In this illustrative embodiment, the key 403 is selectively attachable to the end 501 of the hook 103. To attach the key 403 to the end 501 of the hook 103, the end 501 of the hook 103 opposite the extension (104) of the hanger 101 is inserted into an aperture 502 defined within a connector 504 of the key. In one or more embodiments, the aperture 502 is configured to frictionally retain the key 403 to the end 501 of the hook 103. However, in other embodiments, a latch, snap, one-way latch, or other mating feature can be incorporated into either the aperture 502 or the end 501 of the hook 103 to frictionally retain the key 403 to the end 501 of the hook 103.

In this illustrative embodiment, the aperture 502 and the end 501 of the hook 103 are geometrically configured to prevent rotation of the key 403 about the end 501 of the hook. To wit, here the aperture 502 defines a flat side 505 and two arched protrusions 506,507. The end 501 of the hook 103 have a flat side 509 and two arched indentations 508 that are complementary in shape to the two arched protrusions 506,507. When the end 501 of the hook 103 opposite the extension (104) of the hanger 101 is inserted into an aperture 502 defined within a connector 504 of the key 403, engagement of the two arched protrusions 506,507 with the two arched indentations 508, opposite engagement of the flat side 505 of the aperture 502 with the flat side 505 of the end 501 of the hook 103 prevents rotation of the key 403 about the end 501 of the hook 103.

Figure 6:
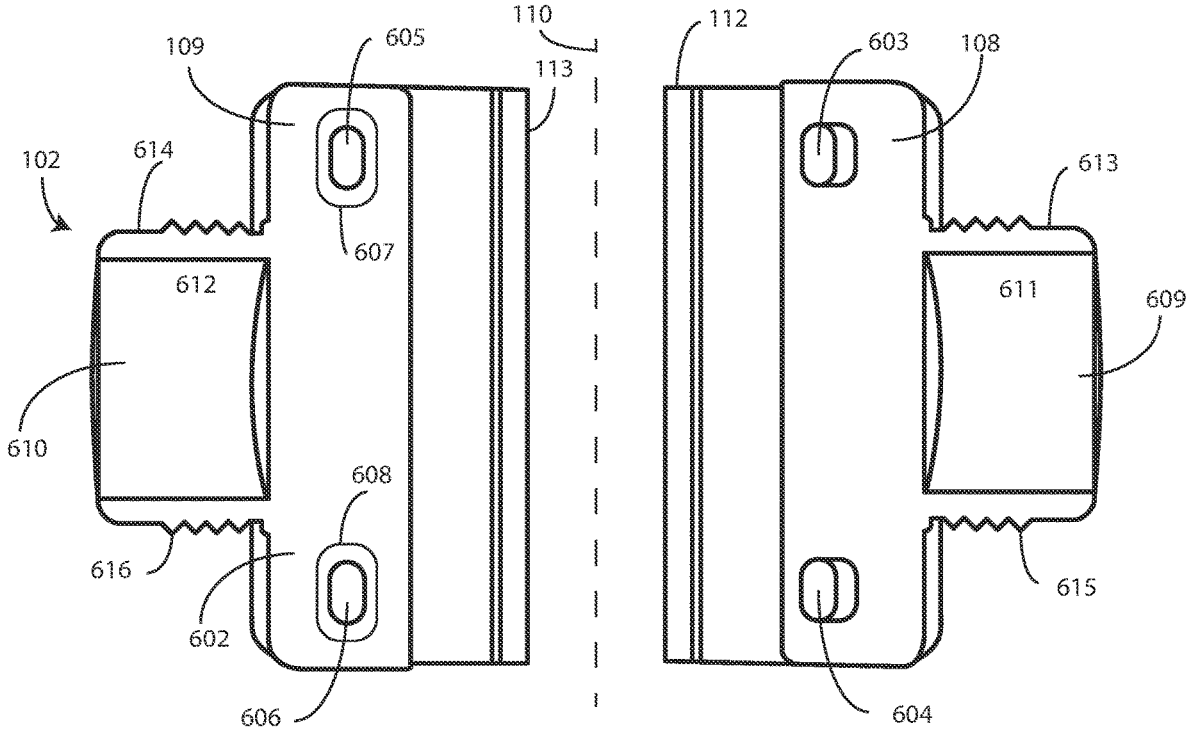
FIG. 6 illustrates one explanatory base member in accordance with one or more embodiments of the disclosure.

Turning now to FIG. 6, illustrated therein are the first base member portion 108 and the second base member portion 109 after having been separated along the medial major axis 110. This separation exposes the inner surfaces 601,602 of the first base member portion 108 and the second base member portion 109, respectively.

In one or more embodiments, the inner surface 601 of the first base member portion 108 comprises one or more bosses 603,604. Here, two bosses 603,604 are shown. However, more or fewer bosses can be included in other embodiments.

In this illustrative embodiment, the inner surface 602 of the second base member portion 109 comprises one or more boss receivers 605,606. Here, two boss receivers 605,606 are shown. However, more or fewer boss receivers can be included in other embodiments. In one or more embodiments, the boss receivers 605,606 comprise apertures that extend into the inner surface 602 of the second base member portion 109, and which have shapes that are complementary to the one or more bosses 603,604 of the inner surface 601 of the first base member portion 108. The one or more boss receivers 605 can optionally include wider mouths 607,608 at their openings to facilitate easier insertion of the one or more bosses 603,604 into the one or more boss receivers 605,606 when the first base member portion 108 and the second base member portion 109 are pressed together such that their inner surfaces 601,602 abut at the medial major axis 110.

In one or more embodiments, when the first base member portion 108 and the second base member portion 109 are pressed together such that their inner surfaces 601,602 abut at the medial major axis 110, the one or more bosses 603,604 insert into the one or more boss receivers 605,606. This prevents the inner surfaces 601,602 of the first base member portion 108 and the second base member portion 109 from sliding about.

In the illustrative embodiment of FIG. 6, the base member 102 includes a head receiver. As will be described in more detail below with reference to FIG. 7, the hanger (101) can also include a head. In this illustrative embodiment, the first base member portion 108 has a first half head receiver 609 extending distally from a side of the first base member portion 108 disposed opposite the first half rail clamp 112. Similarly, the second base member portion 109 has a second half head receiver 610 extending distally from a side of the second base member portion 109 disposed opposite the second half rail clamp 113.

In this illustrative embodiment, the first half head receiver 609 and the second half head receiver 610 are both hemicylindrical. When the first base member portion 108 and the second base member portion 109 are pressed together such that their inner surfaces 601,602 abut at the medial major axis 110, the edges of the first half head receiver 609 and the second half head receiver 610 also abut to define a cylindrical head receiver. While a cylinder is one suitable shape for a head receiver formed by abutment of the edges of the first half head receiver 609 and the second half head receiver 610, other shapes can be used as well. In other embodiments, the head receiver is rectangular, triangular, polygonal, or free form shapes. Still other shapes for the head receiver will be obvious to those of ordinary skill in the art having the benefit of this disclosure.

In one or more embodiments, the inner surfaces 611,612 of the first half head receiver 609 and the second half head receiver 610 define an interior socket to receive the head of a hanger (101) configured in accordance with one or more embodiments of the disclosure. In one or more embodiments, the exterior surfaces 613,614 of the first half head receiver 609 and the second half head receiver 610 define one or more threads 615,616. When the first base member portion 108 and the second base member portion 109 are pressed together such that their inner surfaces 601,602 abut at the medial major axis 110, the edges of the first half head receiver 609 and the second half head receiver 610 also abut to define a cylindrical head receiver having a an interior socket defined by the inner surfaces 611,612 of the first half head receiver 609 and the second half head receiver 610, and having threads defined by the exterior surfaces 613,614 of the first half head receiver 609 and the second half head receiver 610. The coupler (111) can then be threaded onto the threads defined by the exterior surfaces 613,614 of the first half head receiver 609 and the second half head receiver 610 to couple the first base member portion 108 and the second base member portion 109 together.

Figure 7:
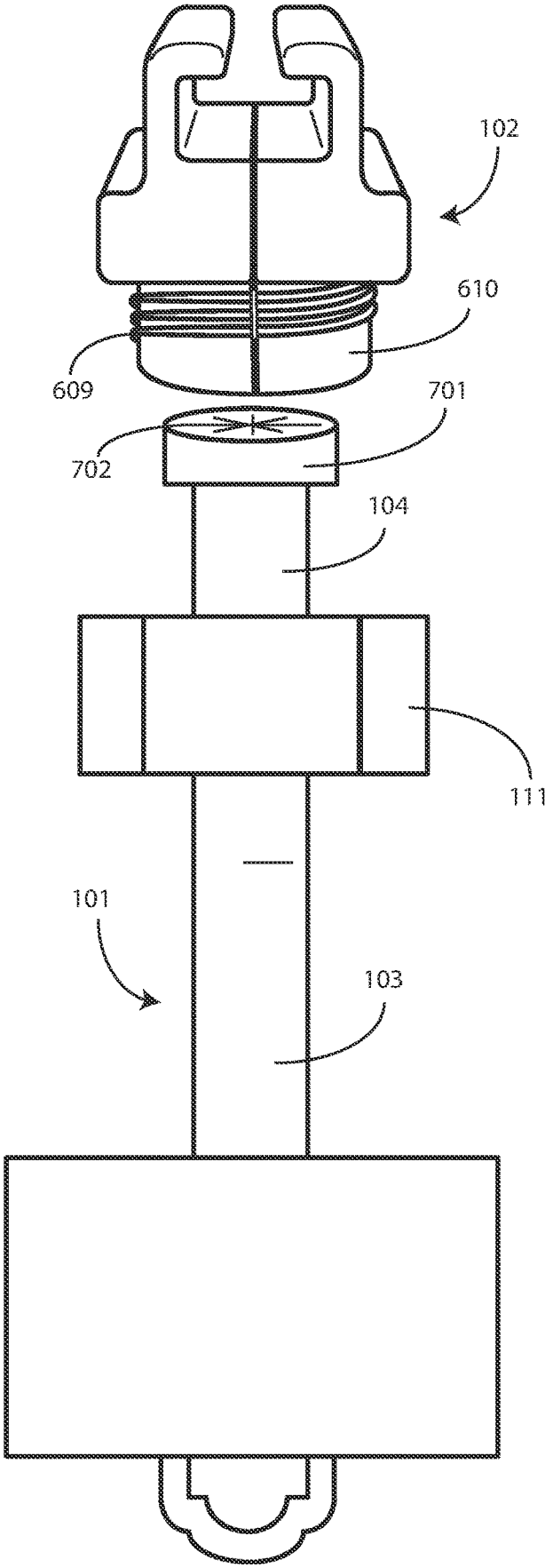
FIG. 7 illustrates one explanatory track hanger prior to assembly in accordance with one or more embodiments of the disclosure.

Turning now to FIG. 7, illustrated therein is the hanger 101 separated from the base member 102. As can be seen in this separated state, in one or more embodiments the hanger 101 includes a head 701, which is coupled to the extension 104. In this illustrative embodiment, the extension 104 is situated between the head 701 and the hook 103.

In this illustrative embodiment, the head 701 is cylindrical. While a cylinder is one suitable shape for the head 701, other shapes can be used as well. In other embodiments, the head 701 is rectangular, triangular, polygonal, or free form shapes. Still other shapes for the head 701 will be obvious to those of ordinary skill in the art having the benefit of this disclosure.

In one or more embodiments, the head 701 and the head receiver defined by the first half head receiver 609 and the second half head receiver 610 are complementary in shape. In this illustrative embodiment, the head 701 and the head receiver defined by the first half head receiver 609 and the second half head receiver 610, when abutting, are cylindrical.

The head receiver defined by the first half head receiver 609 and the second half head receiver 610, or more particularly, the interior socket defined by the inner surfaces (611,612) of the first half head receiver 609 and the second half head receiver 610, is configured to receive the head 701 when the head 701 is inserted into the head receiver defined by the first half head receiver 609 and the second half head receiver 610.

In one or more embodiments, the head 701 can include one or more teeth 702. Where included, the one or more teeth 702 can engage an interior surface of the interior socket defined by the inner surfaces (611,612) of the first half head receiver 609 and the second half head receiver 610, thereby preventing rotation of the head 701 when inserted into the head receiver defined by the first half head receiver 609 and the second half head receiver 610. In one or more embodiments, the interior surface of the interior socket defined by the inner surfaces (611,612) of the first half head receiver 609 and the second half head receiver 610 can include complementary teeth to engage the one or more teeth 702 of the head 701, thereby further preventing rotation of the head 701 when inserted into the head receiver defined by the first half head receiver 609 and the second half head receiver 610. Where rotation of the head 701 within head receiver defined by the first half head receiver 609 and the second half head receiver 610 is desired, the head 701 and the interior surface of the interior socket defined by the inner surfaces (611,612) of the first half head receiver 609 and the second half head receiver 610 can be smooth so as to facilitate movement. Lubricants can be placed between the head 701 and the interior surface of the interior socket defined by the inner surfaces (611,612) of the first half head receiver 609 and the second half head receiver 610 as well.

As shown in FIG. 7, prior to insertion of the head 701 into the interior socket defined by the inner surfaces (611,612) of the first half head receiver 609 and the second half head receiver 610, the coupler 111 is placed about the hanger 101. The head 701 is then inserted into the interior socket defined by the inner surfaces (611,612) of the first half head receiver 609 and the second half head receiver 610. This is shown in FIG. 8.

Figure 8:
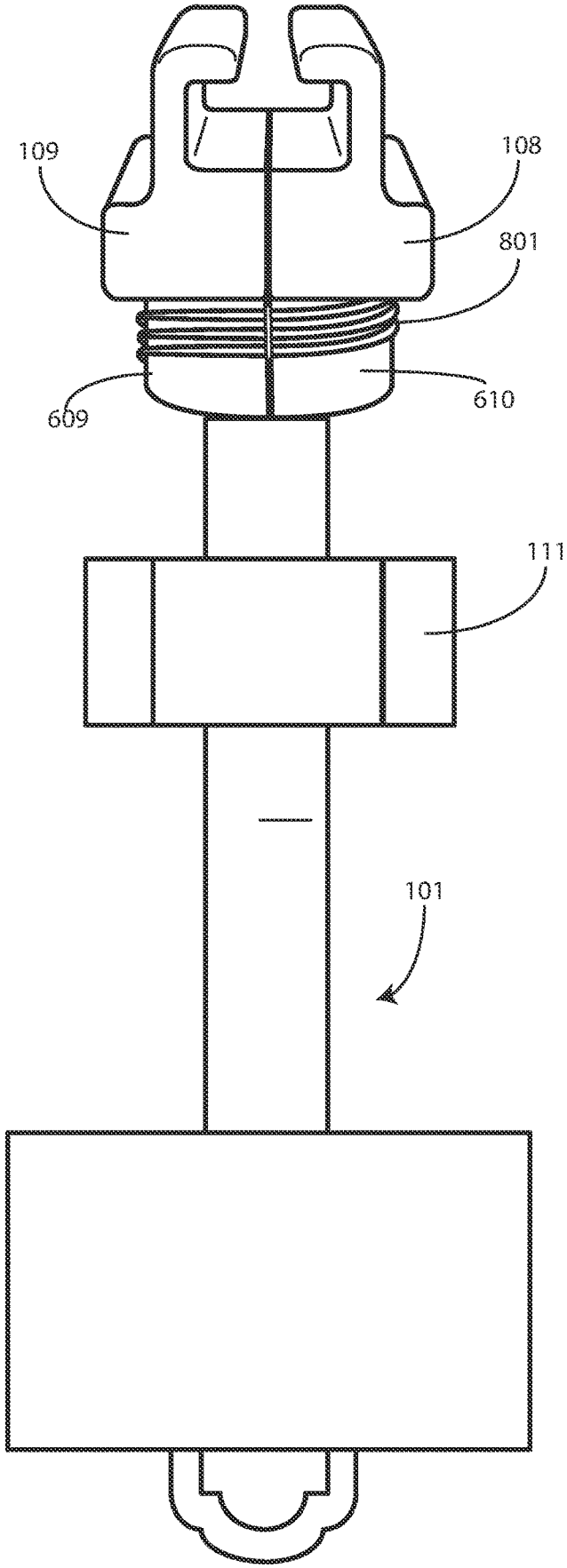
FIG. 8 illustrates a partially assembled track hanger in accordance with one or more embodiments of the disclosure.

Turning now to FIG. 8, once the head (701) is then inserted into the interior socket defined by the inner surfaces (611,612) of the first half head receiver 609 and the second half head receiver 610. The coupler 111, which includes interior threads, can then engage the one or more threads 801 disposed along the exterior surface of the head receiver defined by the first half head receiver 609 and the second half head receiver 610 to retain the first base member portion 108 and the second base member portion 109 together. This engagement of the coupler 111 to the one or more threads 801 disposed along the exterior surface of the head receiver defined by the first half head receiver 609 and the second half head receiver 610 also retains the head (701) of the hanger 101 within the interior socket defined by the inner surfaces (611,612) of the first half head receiver 609 and the second half head receiver 610. Said differently, in one or more embodiments, when the head (701) is inserted into the head receiver defined by the first half head receiver 609 and the second half head receiver 610, the coupler 111 is operable to engage the exterior surface of the head receiver defined by the first half head receiver 609 and the second half head receiver 610 to retain the head (701) within the head receiver defined by the first half head receiver 609 and the second half head receiver 610.

Figure 9:
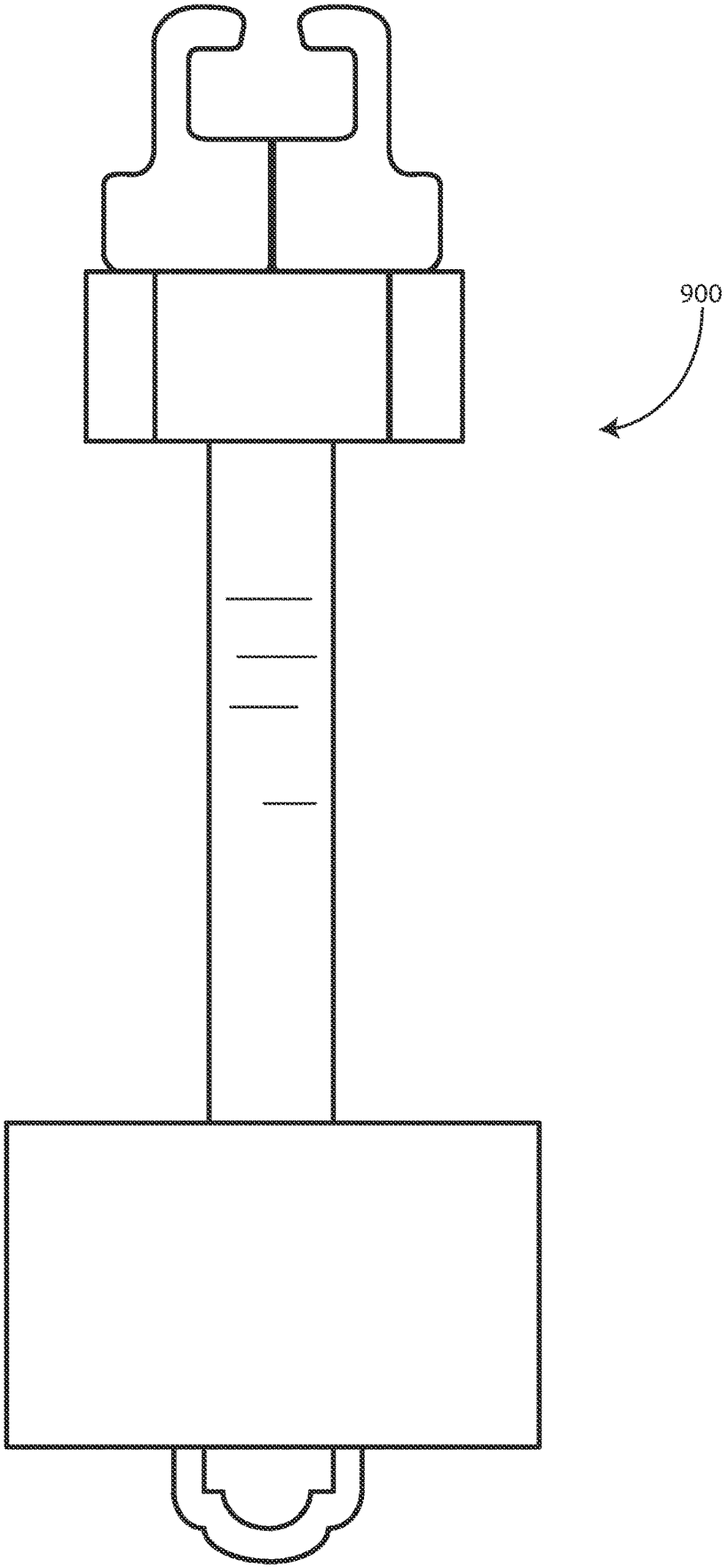
FIG. 9 illustrates an assembled track hanger in accordance with one or more embodiments of the disclosure.
Figure 10:
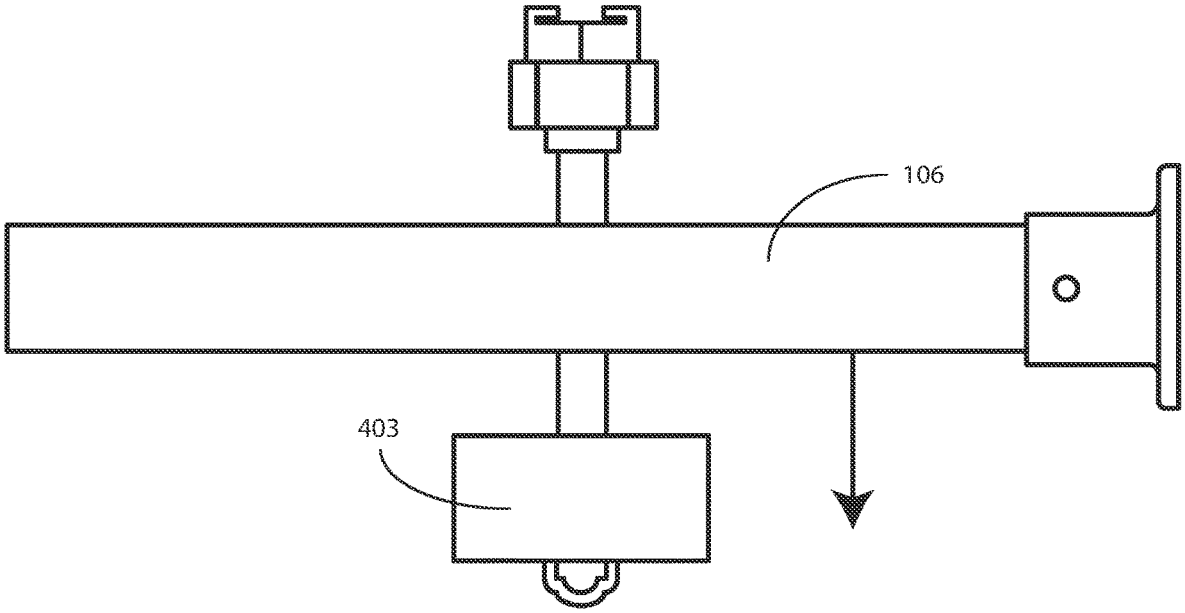
FIG. 10 illustrates a partially assembled track hanger system in accordance with one or more embodiments of the disclosure.

The completed hanger assembly 900 is shown in FIG. 9. As shown in FIG. 10, the track 106 can then be attached to the key 403 as described above with reference to FIG. 4, thereby yielding the embodiment shown in FIGS. 1-3.

Figure 11:
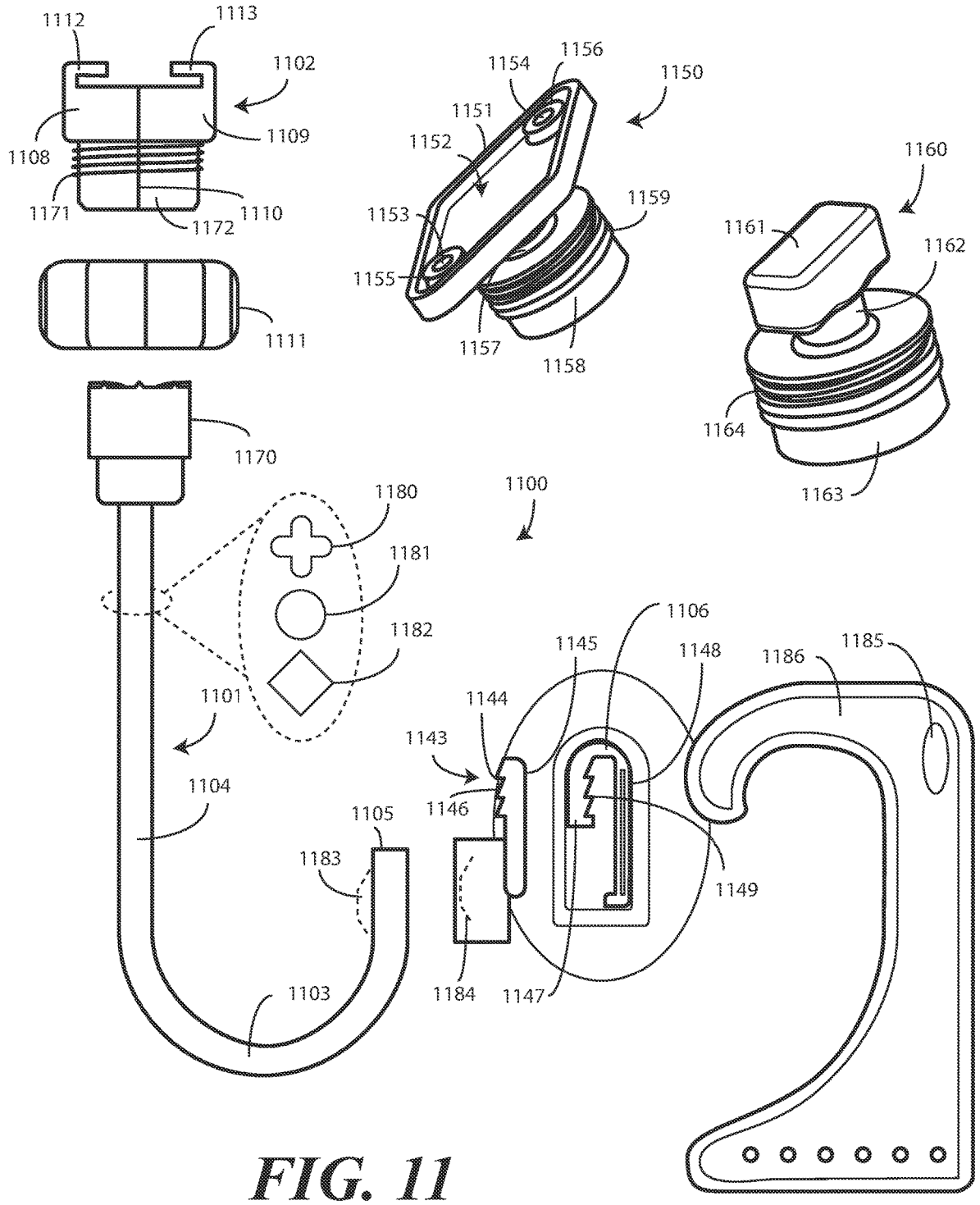
FIG. 11 illustrates a perspective view of another explanatory track hanger system in accordance with one or more embodiments of the disclosure.

Turning now FIG. 11, illustrated therein is another explanatory embodiment of a track hanger 1100 configured in accordance with one or more embodiments of the disclosure. In one embodiment, the track hanger 1100 is to suspend a track from a surface such as a wall or ceiling.

The track hanger 1100, in one or more embodiments, includes a hanger 1101, a base member 1102, and a key 1143. In this illustrative embodiment, the hanger 1101 has a circular cross section 1181. However, the hanger 1101 can have other cross sections as well. For example, in another embodiment the hanger 1101 has a cross section 1180 configured as a cross or an "X." In still another embodiment, the hanger 1101 has a cross section 1182 that is a square or diamond. Other cross sections, such as ovals, free form shapes, polygons, and the like, will be obvious to those of ordinary skill in the art having the benefit of this disclosure.

In one or more embodiments, each of the hanger 1101, the base member 1102, and the key 1143 are separable from each other. For example, in one embodiment the hanger 1101 can be detached from the base member 1102. Similarly, the key 1143 can be detached from the hanger 1101. However, in other embodiments, one or more of the hanger 1101, base member 1102, or the key 1143 can be integrated with, or perdurably connected to, another of the hanger 1101, base member 1102, or the key 1143. Illustrating by example, in one or more embodiments the base member 1102 and the hanger 1101 can be constructed as a single, integrated, unitary component. In one embodiment, base member 1102 and hanger 1101 are constructed as a single, integrated, unitary component. Similarly, base member 1150 and hanger 1101 can be constructed as a single, integrated, unitary component. Moreover, base member 1160 and hanger 1101 can be constructed as a single, integrated, unitary component, and so forth.

In this illustration, three different and interchangeable base members 1102,1150,1160 are shown. The first base member 1102 is a track clip base member, while the second base member 1150 is a screw adaptor base member. The third base member 1160 is a track insertion base member. The first base member 1102 is similar to that shown above with reference to FIGS. 1-4.

The second base member 1150 includes a quadrilateral attachment support 1151 that defines a recess 1152 along its upper surface. Two apertures 1153,1154, through which screws can be inserted from the lower surface of the quadrilateral attachment support 1151, through the apertures 1153,1154, and out the upper surface of the quadrilateral attachment support 1151 to attach the second base member 1150 to a ceiling. Each aperture 1153,1154 is surrounded by a boss 1155,1156 in the recess 1152. The recess 1152 is bounded by a perimeter wall as shown in this illustrative embodiment. A head receiver 1158 includes one or more threads 1159 as previously described. A neck 1157, which has a diameter that is smaller than that of the head receiver 1158, and is also narrower than a minor dimension of the quadrilateral of the quadrilateral attachment support 1151, separates the quadrilateral attachment support 1151 and the head receiver 1158.

The third base member 1160 includes a rectangular track insertion head 1161 that can be inserted into a track with the major axis of the rectangular track insertion head 1161 parallel to the major axis of the track. A head receiver 1163 includes one or more threads 1164 as previously described. A neck 1162, which has a diameter that is smaller than that of the head receiver 1163, and is also narrower than a minor dimension of the rectangular track insertion head 1161, separates the rectangular track insertion head 1161 and the head receiver 1163.

In one or more embodiments, the hanger 1101 comprises a hook 1103 and an extension 1104. In one or more embodiments, the key 1143 attaches to a distal end 1105 of the hook 1103. Accordingly, where the key 1143 is detachable from the hanger 1101, the attachment location to attach or detach the key 1143 from the hook 1103 is the distal end 1105. Thus, in one or more embodiments the key 1143 is detachable from the hook 1103.

In one embodiment, the distal end 1105 of the hook 1103 simply inserts into the key 1143, with a friction fit holding the two components together. In another embodiment, a protrusion 1183 disposed along the distal end 1105 of the hook 1103 inserts into a recess 1184 configured in the key 1143 for a snap fit. Other engagements for the distal end 1105 of the hook 1103 and the key 1143 will be obvious to those of ordinary skill in the art having the benefit of this disclosure.

In one embodiment, the hanger 1101 is configured as a single, unitary element. Said differently, in one embodiment the hook 1103 and the extension 1104 are manufactured as a single, integral unit. In this illustrative embodiment, the hanger 1101 also includes a head 1170. Where included, the hook 1103, the extension 1104, and the head 1170 can be manufactured as a single, integral unit as previously described.

In one embodiment the key 1143 includes a first major surface 1144 and a second major surface 1145. In this illustrative embodiment, the first major surface 1144 defines one or more barbs 1146. Each barb comprises a hemi-triangular protrusion with the base of each hemi-triangular protrusion being disposed beneath the side of the hemi-triangular protrusion. In this illustrative embodiment, the second major surface 1145 is substantially planar.

In one or more embodiments, a track 1106 attaches to the key 1143. In this illustrative embodiment, the track 1106 has a first flat side 1147 and a second flat side 1148. An arch spans between ends of the first flat side 1147 and the second flat side 1148 in this embodiment. In one embodiment, the track 1106 is flexible so that it can be shaped into different contours when attached to a track hanger 1100.

In one embodiment, the track 1106 is a continuous piece. In other embodiments, segments of different tracks can be aligned end-to-end to form a composite track. In one embodiment, the track 1106 is malleable. While the cross section of the track 1106 shown in FIG. 10 is generally flat along each of the first flat side 1147 and the second flat side 1148, it should be noted that the cross section could take other shapes as well, such as ovular or flat.

In one embodiment the track 1106 is configured so as to be easily cleanable. In one embodiment, the track 1106 is manufactured so as to be light beige in color. In one embodiment, the track 1106 is cut to predefined lengths, such as twenty-foot lengths. In one or more embodiments, the ends of the track 1106 can be contoured for smooth interconnection to adjacent track segments.

The inclusion of the first flat side 1147, the second flat side 1148, and the arch define a peninsular indentation into which the key 1143 may be inserted. In this illustrative embodiment, the track 1106 comprises one or more complementary barbs 1149. Each of the one or more complementary barbs 1149 is complementary in shape to the one or more barbs 1146 of the key 1143. Here, each complementary barb comprises an inverted hemi-triangular protrusion with a base of each inverted hemi-triangular protrusion being disposed above a side of the inverted hemi-triangular protrusion.

Using this configuration, the one or more barbs 1146 of the key 1143 facilitate one-way penetration of the key 1143 into the track 1106. In one or more embodiments, the track 1106 is manufactured from a pliable material, such as a thermoplastic. When the key 1143 is inserted into the peninsular indentation, the first flat side 1147 of the track 1106 flexes so that the one or more complementary barbs 1149 of the track 1106 pass over the one or more barbs 1146 of the key 1143. Once the key 1143 is fully inserted into the peninsular indentation of the track 1106, first flat side 1147 of the track 1106 flex back toward the key 1143, thereby causing the one or more complementary barbs 1149 to engage the one or more barbs 1146 of the key 1143. This results in the key 1143 being frictionally retained within the track 1106.

In one or more embodiments, the second flat side 1148 of the track 1106 terminates at an end opposite the arch in an L-shaped latch. In one or more embodiments, the second major surface 1145 of the key includes a complementary L-shaped indention into which the base of the "L" of the L-shaped latch seats when the key 1143 is fully inserted into the track 1106.

In operation, when the key 1143 is inserted into the peninsular indentation, the second flat side 1148 of the track 1106 flexes so the base of the "L" of the L-shaped latch of the track 1106 can pass over the second flat side 1148 of the key 1143. Once the key 1143 is fully inserted into the peninsular indentation of the track 1106, second flat side 1148 of the track 1106 flexes back toward the key 1143, thereby causing the base of the "L" of the L-shaped latch to seat within the complementary L-shaped indention of the key 1143. This assists in retaining the key 1143 within the track 1106.

In one or more embodiments, the base member 1102 comprises a first base member portion 1108 and a second base member portion 1109. In one or more embodiments, the first base member portion 1108 and the second base member portion 1109 are separable along a medial major axis 1110. In the illustrative embodiment of FIG. 10, the first base member portion 1108 and the second base member portion 1109 have been placed together such that their inner surfaces abut along the medial major axis 1110. A coupler 1111, which in this embodiment is a plastic hex nut, couples the first base member portion 1108 and the second base member portion 1090 together to retain the inner surfaces abutting at the medial major axis 1110.

In one or more embodiments, the first base member portion 1108 defines a first half rail clamp 1112. Similarly, the second base member portion 1109 defines a second half rail clamp 1113. Each of the first half rail clamp 1112 and the second half rail clamp 1113 includes a vertical member extending distally from the first base member portion 1108 and the second base member portion 1109, respectively, and a horizontal member extending distally from its respective vertical member only a portion of the width of the first base member portion 1108 and the second base member portion 1109. This leaves a gap between each horizontal member, as shown.

Separating the first base member portion 1108 from the second base member portion 1109 along the medial major axis 1110 therefore separates the first half rail clamp 1112 from the second half rail clamp 1113. When used with a drop ceiling having a suspension grid of rails, one can simply place the first half rail clamp 1112 to the left of a rail and the second half rail clamp 1113 to the right of the rail, or vice versa. The first base member portion 1108 can then be pressed against the second base member portion 1109 along the medial major axis 1110. This causes the rail of the suspension grid to be caught between the first half rail clamp 1112 and the second half rail clamp 1113.

When the coupler 1111 is then be attached to the base member 1102 to retain the first base member portion 1108 against the second base member portion 1109, this causes the first half rail clamp 1112 from the second half rail clamp 1113 to couple the track hanger 1100 to the rail of the suspension grid. In one or more embodiments, the coupler 1111 engages one or more threads 1171 disposed on the exterior surface of a head receiver 1172 extending distally from the base member 1102 to retain the first base member portion 1108 against the second base member portion 109. The coupler 1111 can also be used to retain a head 1170, which is attached to the extension 1104 and hook 1103, within an interior socket supporting the threads. Thus, in one or more embodiments, the track hanger 1100 comprises a uniquely configured base member 1102 that facilitates simple mounting and dismounting of the track hanger 1100 to a track of a conventional suspension grid of a drop ceiling. The hanger 1186 can optionally include an aperture 1185 in its top corner. The track hanger 1100 can be assembled as previously described above with reference to FIGS. 7-9.

Figure 12:
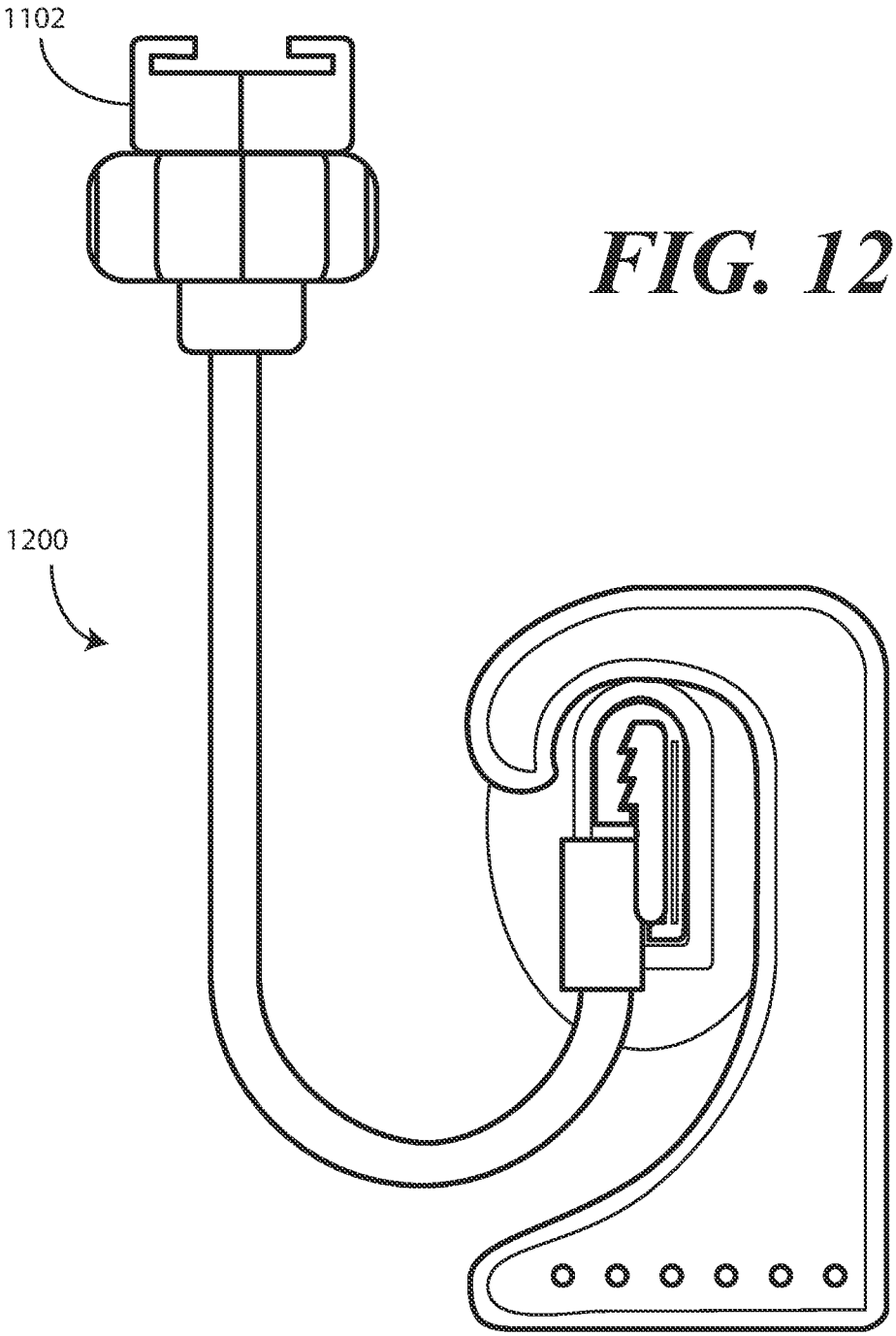
FIG. 12 illustrates another assembled track hanger in accordance with one or more embodiments of the disclosure.
Figure 13:
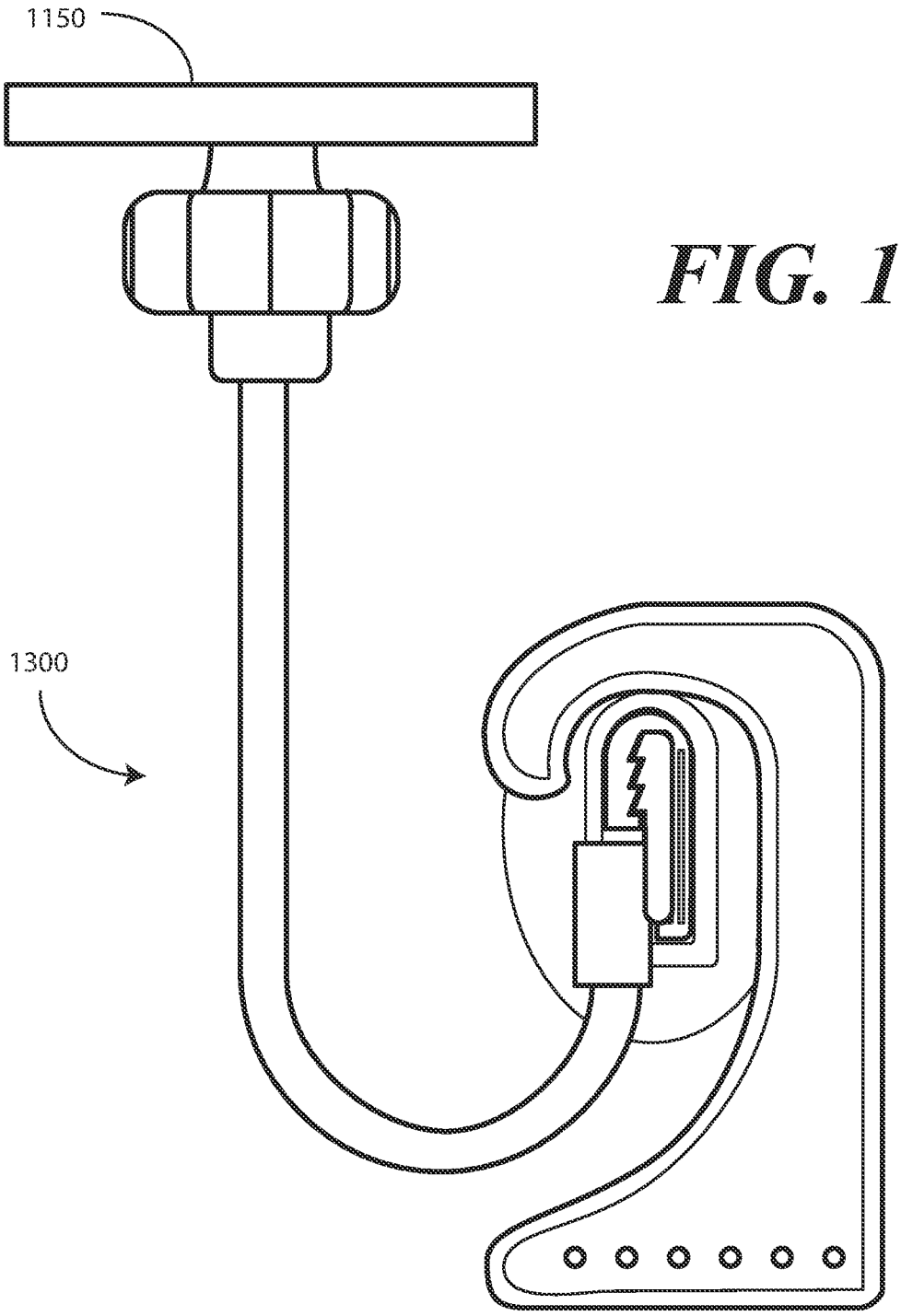
FIG. 13 illustrates another assembled track hanger in accordance with one or more embodiments of the disclosure.
Figure 14:
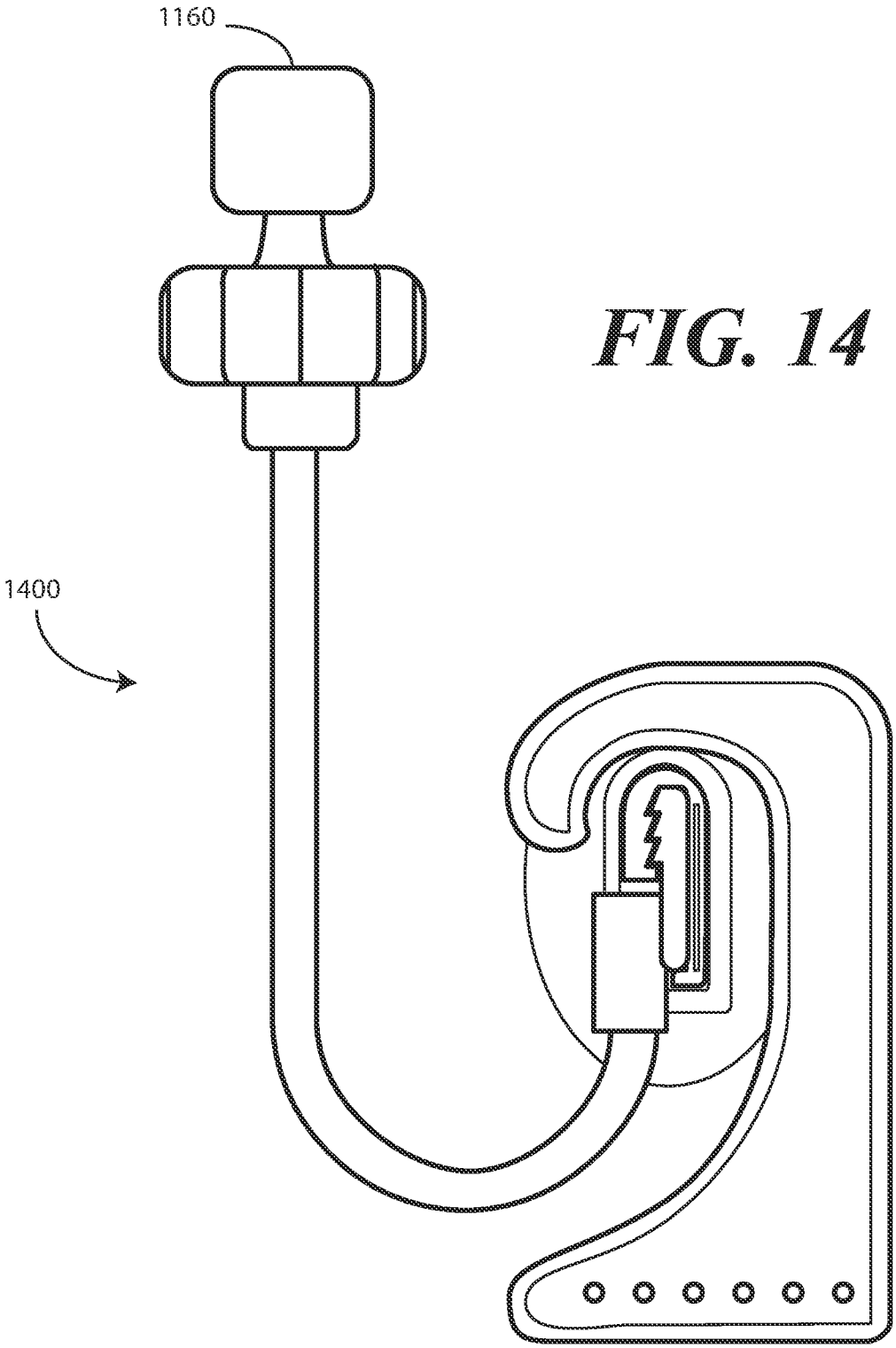
FIG. 14 illustrates yet another assembled track hanger in accordance with one or more embodiments of the disclosure.
Figure 15:
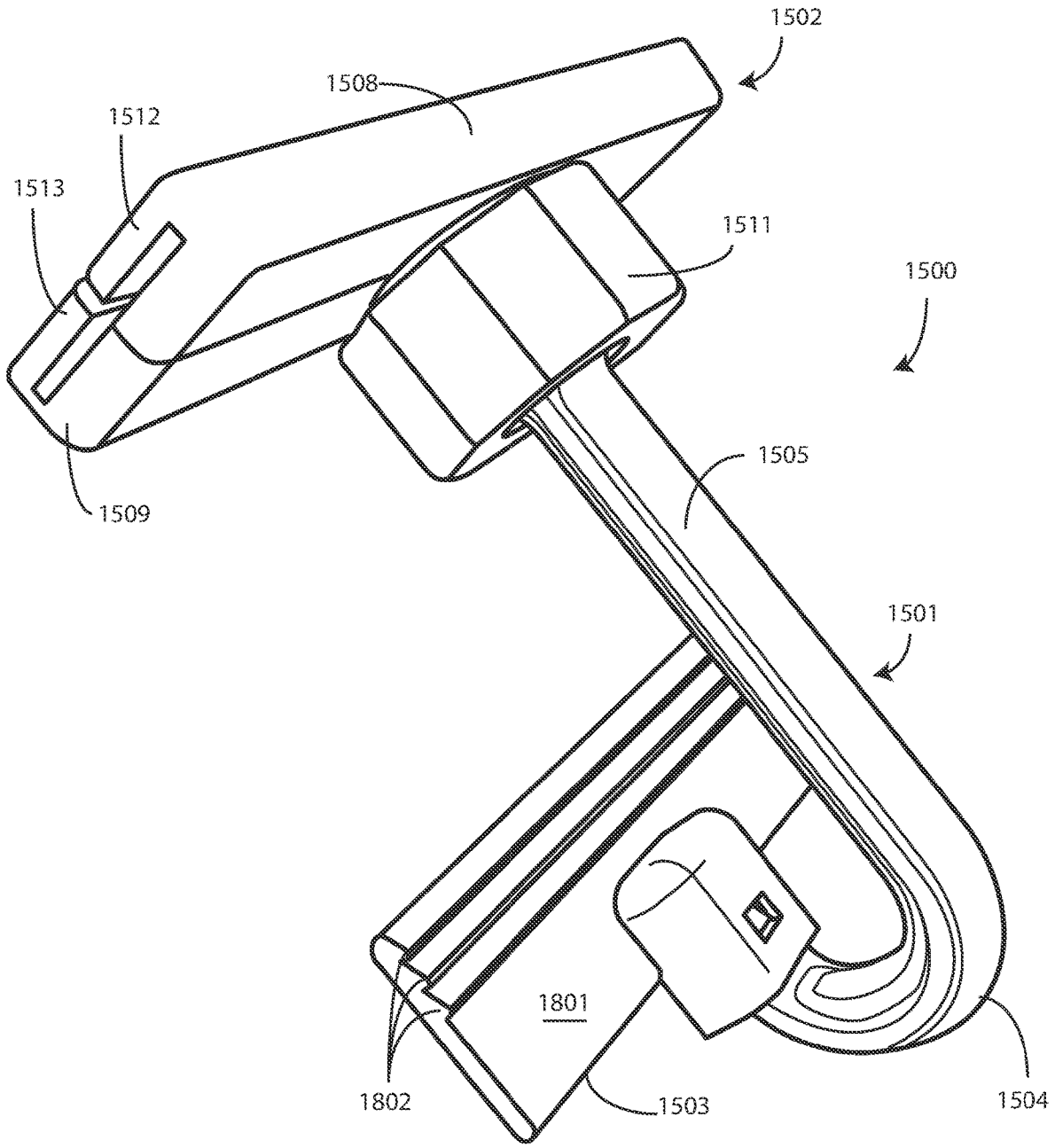
FIG. 15 illustrates a perspective view of another explanatory track hanger system in accordance with one or more embodiments of the disclosure.

The completed hanger assembly 1200 using the first base member 1102 is shown in FIG. 12. The completed hanger assembly 1300 using the second base member 1150 is shown in FIG. 13. The completed hanger assembly 1400 using the first base member 1102 is shown in FIG. 14.

Turning now to FIGS. 15-20, illustrated therein is another explanatory embodiment of a track hanger 1500 configured in accordance with one or more embodiments of the disclosure. In one embodiment, the track hanger 1500 is to suspend a track from a surface such as a wall or ceiling.

Figure 16:
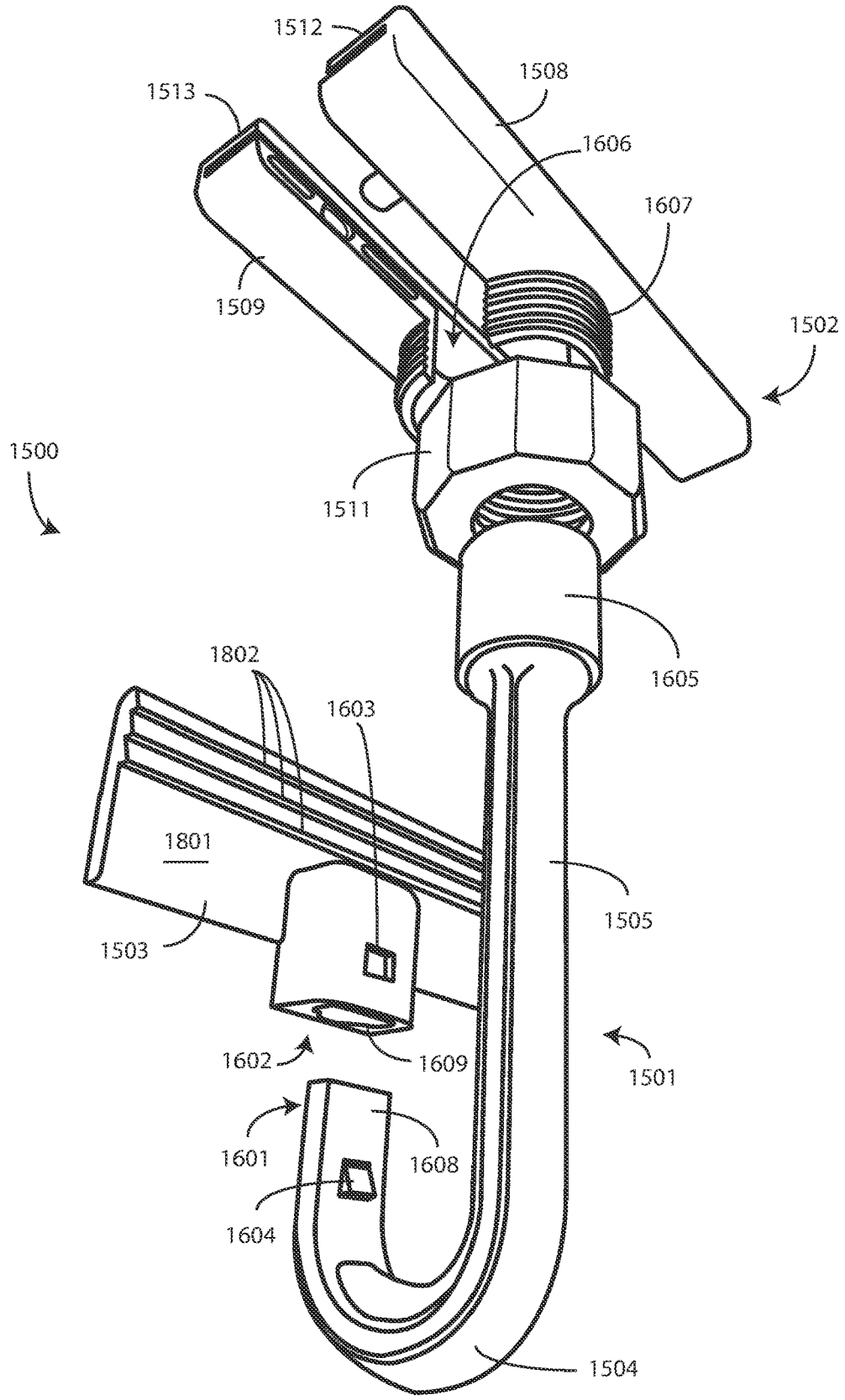
FIG. 16 illustrates another perspective view of another explanatory track hanger system in accordance with one or more embodiments of the disclosure, illustrating another explanatory key and hook tip in accordance with one or more embodiments of the disclosure.

The track hanger 1500, in one or more embodiments, includes a hanger 1501, a base member 1502, and a key 1503. In one or more embodiments, each of the hanger 1501, the base member 1502, and the key 1503 are separable from each other. For example, in one embodiment the hanger 1501 can be detached from the base member 1502. Similarly, as shown in FIG. 16, the key 1503 can be detached from the hanger 1501. It should be noted that the track hanger 1500 can be manufactured in different sizes and shapes so as to be compatible with, and fit appropriately, differently sized suspension grids of drop ceilings.

In one or more embodiments, the hanger 101 comprises a hook 1504 and an extension 1505. In one or more embodiments, the key 1503 attaches to a distal end 1601 of the hook 1504. Accordingly, where the key 1503 is detachable from the hanger 1501, the attachment location to attach or detach the key 1503 from the hook 1504 is the distal end 1601. In one or more embodiments, the key 1503 includes a distal end receiver 1602 into which the distal end 1601 of the hook 1504 inserts. The distal end receiver 1602 can define one or more engagement recesses 1603 to receive one or more engagement protrusions 1604 projecting from the distal end 1601 of the hook 1504 to retain the key 1503 to the distal end 1601 of the hook 1504 in one or more embodiments. In one or more embodiments the key 1503 is detachable from the hook 1504.

In one or more embodiments, the hanger 1501 comprises a head 1605 that is attached to the extension 1505. In one embodiment shown in FIG. 16, the hanger 1501 is configured as a single, unitary component. Said differently, in one embodiment the hook 1504, the extension 1505, and the head 1605 coupled to the extension 1505 are manufactured as a single, integral unit.

Illustrating by example, in one embodiment the hook 1504, the extension 1505, and the head 1605 are manufactured from a thermoplastic material by way of an injection molding process. The hook 1504, the extension 1505, and the head 1605 can be manufactured from nylon, styrene, ABS, polycarbonate, or polycarbonate-ABS, PMMA, PVC, or other polyamide-based thermoplastics in one embodiment. Other materials suitable for manufacturing the hook 1504, the extension 1505, and the head 1605 will be obvious to those of ordinary skill in the art having the benefit of this disclosure.

While the base member 1502 and the key 1503 can be separable from the hanger 101, in one or more embodiments the base member 1502 and the key 1503 can be manufactured from the same material as is the hanger 1501. In other embodiments, the hanger 1501 is manufactured from materials different from the base member 1502 and/or key 1503. The base member 1502, hanger 1501, and key 1503 can each be manufactured from different materials as well.

Figure 17:
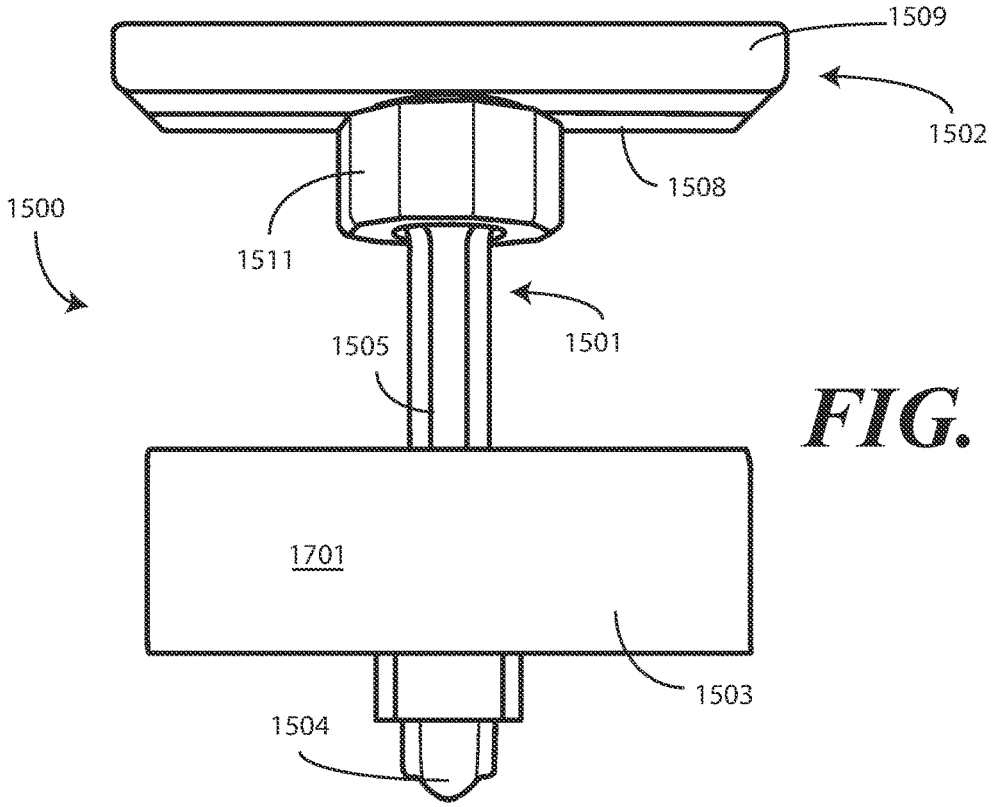
FIG. 17 illustrates a front elevation view of another explanatory track hanger system in accordance with one or more embodiments of the disclosure.
Figure 18:
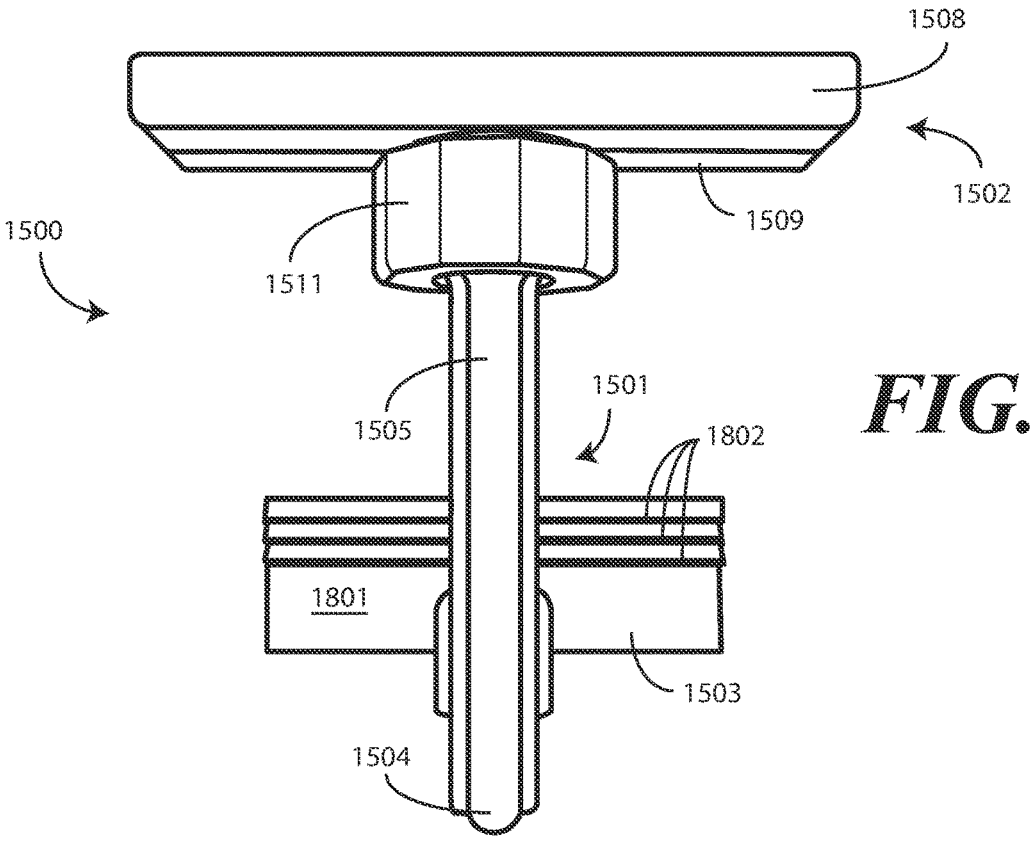
FIG. 18 illustrates a rear elevation view of another explanatory track hanger system in accordance with one or more embodiments of the disclosure.
Figure 19:
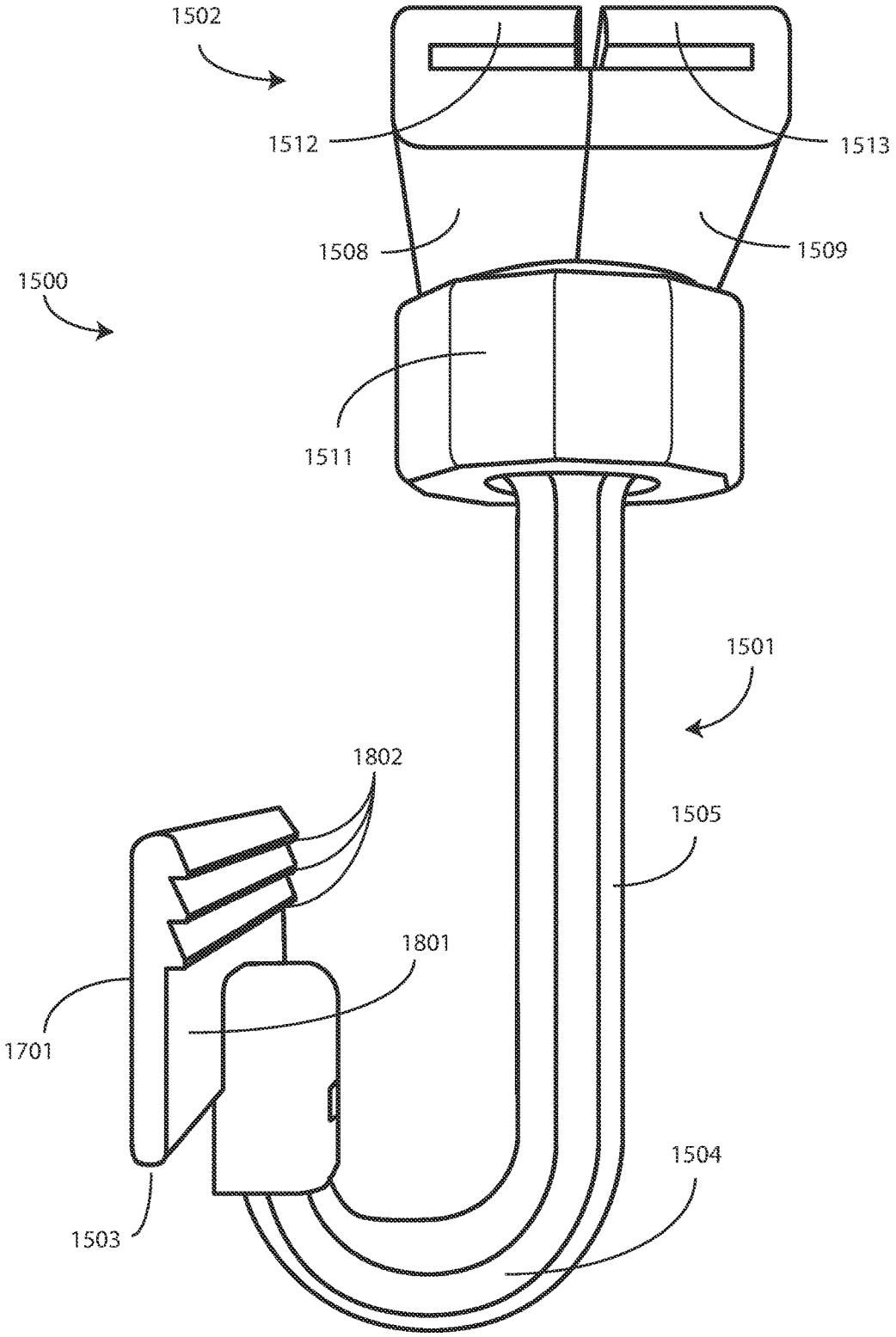
FIG. 19 illustrates a side elevation view of another explanatory track hanger in accordance with one or more embodiments of the disclosure.

As best seen by comparing FIGS. 17-18, in one embodiment the key 1503 includes a first major surface 1801 and a second major surface 1701. In this illustrative embodiment, the first major surface 1801 defines one or more barbs 1802. As best shown in FIG. 19, in one or more embodiments each barb 1802 comprises a hemi-triangular protrusion with the base of each hemi-triangular protrusion being disposed beneath the side of the hemi-triangular protrusion. In this illustrative embodiment, the second major surface 1701 is substantially planar.

In one or more embodiments, a track (106) attaches to the key 1503 as previously described. For example, in one or more embodiments the track (106) has a first flat side (407) and a second flat side (408), with an arch (409) spanning between ends of the first flat side (407) and the second flat side (408). The track (106) can be flexible so that it can be shaped into different contours when attached to a track hanger 1500.

In one or more embodiments, the inclusion of the first flat side (407), the second flat side (408), and the arch (409) define a peninsular indentation (410) into which the key 1503 may be inserted. The track (106) can comprise one or more complementary barbs (405). Each of the one or more complementary barbs (405) is, in one or more embodiments, complementary in shape to the one or more barbs 1802 of the key 1503. For example, each complementary barb can comprise an inverted hemi-triangular protrusion with a base of each inverted hemi-triangular protrusion being disposed above a side of the inverted hemi-triangular protrusion.

Using this configuration, the one or more barbs 1802 of the key 1503 facilitate one-way penetration of the key 1503 into the track (106). In one or more embodiments, when the key 1503 is inserted into the peninsular indentation (410), the first flat side (407) of the track (106) flexes so that the one or more complementary barbs (405) of the track (106) pass over the one or more barbs 1802 of the key 1503. Once the key 1503 is fully inserted into the peninsular indentation (410) of the track (106), first flat side (407) of the track (106) flex back toward the key 1503, thereby causing the one or more complementary barbs (405) to engage the one or more barbs 1802 of the key 1503. This results in the key 1503 being frictionally retained within the track (106) as previously described.

In one or more embodiments, the base member 1502 comprises a first base member portion 1508 and a second base member portion 1509. In one or more embodiments, the first base member portion 1508 and the second base member portion 1509 are separable along a medial major axis 2010. In the illustrative embodiment of FIGS. 15-20, the first base member portion 1508 and the second base member portion 1509 can be placed together such that their inner surfaces abut along the medial major axis 2010 to define the base member 1502. A coupler 1511, which in this embodiment is a plastic hex nut, couples the first base member portion 1508 and the second base member portion 1509 together to retain the inner surfaces abutting at the medial major axis 2010.

In one or more embodiments, the first base member portion 1508 defines a first half rail clamp 1512. Similarly, the second base member portion 1509 defines a second half rail clamp 1513. Each of the first half rail clamp 1512 and the second half rail clamp 1513 includes a vertical member extending distally from the first base member portion 1508 and the second base member portion 1509, respectively, and a horizontal member extending distally from its respective vertical member only a portion of the width of the first base member portion 1508 and the second base member portion 1509. This leaves a gap between each horizontal member, as shown in FIGS. 15, 16, 19, and 20.

Separating the first base member portion 1508 from the second base member portion 1509 along the medial major axis 2010 therefore separates the first half rail clamp 1512 from the second half rail clamp 1513. When used with a drop ceiling having a suspension grid of rails, one can simply place the first half rail clamp 1512 to the left of a rail and the second half rail clamp 1513 to the right of the rail, or vice versa. The first base member portion 1508 can then be pressed against the second base member portion 1509 along the medial major axis 2010. This causes the rail of the suspension grid to be caught between the first half rail clamp 1512 and the second half rail clamp 1513.

In one or more embodiments, the first base member portion 1508 defines a first half head-receiving aperture 2001, while the second base member portion 1509 defines a second half head-receiving aperture 2002. In one or more embodiments, coupling the first base member portion 1508 to the second base member portion 1509 causes the first half head-receiving aperture 2001 to abut the second half head-receiving aperture 2002, thereby resulting in the base member 1502 defining a head-receiving aperture 1606 into which the head 1605 of the hanger 1501 may situate.

Figure 20:
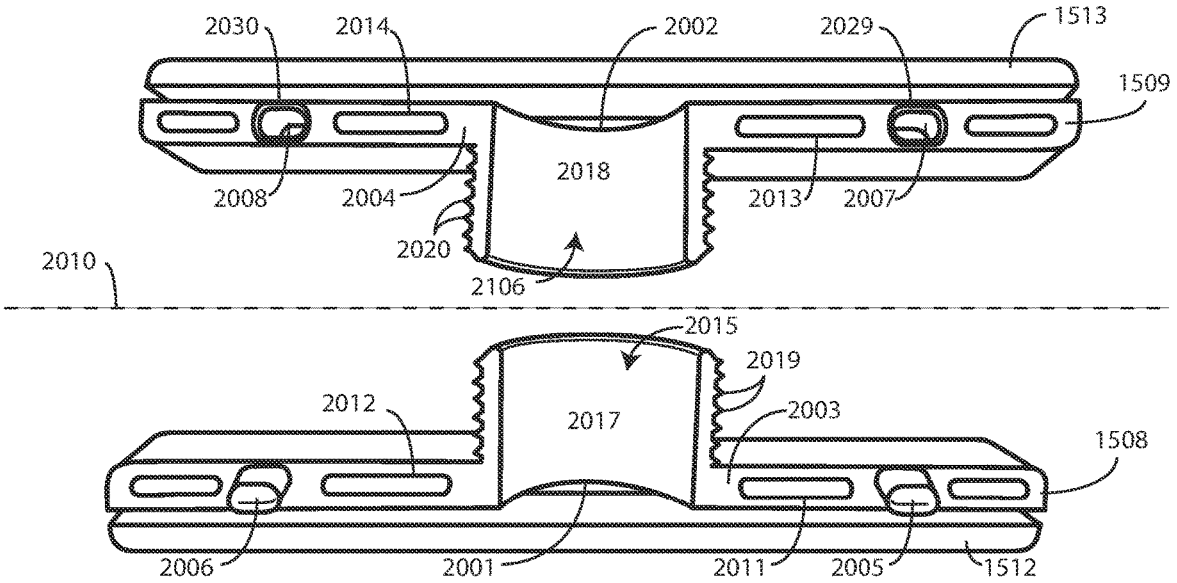
FIG. 20 illustrates another explanatory base member in accordance with one or more embodiments of the disclosure.

As shown in FIG. 20, the head-receiving aperture 1606 is defined in a planar surface of the base member formed by coupling the first base member portion 1508 to the second base member portion 1509 that is situated opposite the first half rail clamp 1512 and the second half rail clamp 1513. Effectively, this allows the head 1605 of the hanger 1501 to be exposed to the first half rail clamp 1512 and the second half rail clamp 1513. That the head 1605 of the hanger 1501 is exposed to the first half rail clamp 1512 and the second half rail clamp 1513 means that the head 1605 can be inserted into the head receiver defined by the first half head receiver 2015 and the second half head receiver 2016 until it touches the first half rail clamp 1512 and the second half rail clamp 1513. When a rail is positioned or situated within the first half rail clamp 1512 and the second half rail clamp 1513, as shown below in FIG. 22, that the head 1605 of the hanger 1501 is exposed to the first half rail clamp 1512 and the second half rail clamp 1513 means that the head 1605 can be inserted into the head receiver defined by the first half head receiver 2015 and the second half head receiver 2016 until it abuts or intersects with the rail.

That the head 1605 of the hanger 1501 is exposed to the first half rail clamp 1512 and the second half rail clamp 1513 additionally means that threading the coupler 1511 onto the first base member portion 1508 and the second base member portion 1509 moves the head 1605 of the hanger 1501 toward the first half rail clamp 1512 and the second half rail clamp 1513 until at least a portion of the head 1605 is exposed within the gap defined by the first half rail clamp 1512 and the second half rail clamp 1513. It is this exposure that provides the unique clamping function of the head 1605 of the hanger 1501 against the rail.

In one or more embodiments, the hanger 1501 is then coupled to the base member 1502. The coupler 1511 couples the first base member portion 1508 and the second base member portion 1509. Where the base member 1502 defines the head-receiving aperture 1606, with the head 1605 of the hanger 1501 situated therein, the coupler 1511 not only retains the inner surfaces abutting at the medial major axis 2010, but also moves the head 1605 of the hanger 1501 toward the first half rail clamp 1512 and the second half rail clamp 1513. Where a rail is situated in the first half rail clamp 1512 and the second half rail clamp 1513, this causes the head 1605 of the hanger 1501 to lock into the head-receiving aperture 1606 of the base member 1502 such that the head 1605 is able to "clamp" onto the rail passing through the base member 1502.

Thus, in one or more embodiments a first base member portion 1508 comprises a first half rail clamp 1512 and defines a first half head-receiving aperture 2001. A second base member portion 1509 is coupled to the first base member portion 1508. In one or more embodiments, the second base member portion 1509 comprises a second half rail clamp 1513 and defines a second half head-receiving aperture 2002. A head 1605 of a hanger 1501 situates within the head receiving aperture defined by the first half head-receiving aperture 2001 and the second half head-receiving aperture 2002 abutting. In one or more embodiments, an upper surface of the head 1605 is exposed to the first half rail clamp 1512 and the second half rail clamp 1513 through the head-receiving aperture. A coupler 1511 couples the first base member portion 1508 to the second base member portion 1509. In one or more embodiments, threading the coupler 1511 onto the first base member portion 1508 and the second base member portion 1509 moves the head 1605 of the hanger 1501 toward the first half rail clamp 1512 and the second half rail clamp 1513 due to the head's exposure through the head-receiving aperture. Continuing to thread the coupler 1511 onto the first base member portion 1508 and the second base member portion 1509, when a rail is situated between the first half rail clamp 1512 and the second half rail clamp 1513, causes the head 1605 of the hanger 1501 to clamp onto the rail.

In one or more embodiments, separating the first base member portion 1508 from the second base member portion 1509 along the medial major axis 2010 then separates the first half rail clamp 1512 from the second half rail clamp 1513 while also separating the head-receiving aperture 1606. When used with a drop ceiling having a suspension grid of rails, one can simply place the first half rail clamp 1512 to the left of a rail and the second half rail clamp 1513 to the right of the rail, or vice versa.

The first base member portion 1508 can then be pressed against the second base member portion 1509 along the medial major axis 2010. In one or more embodiments, this causes the rail of the suspension grid to be caught between the first half rail clamp 1512 and the second half rail clamp 1513. The head 1605 of the hanger 1501 can then be situated within the head-receiving aperture 1606. The coupler 1511 can then be attached to the base member 1502 to both retain the first base member portion 1508 against the second base member portion 1509 and to clamp the head 1605 of the hanger 1501 against the rail. The coupler 1511 can be coupled and uncoupled as desired so as to allow quick and easy coupling of the base member 1502 and head 1605 of the hanger 1501 to the rails of the suspension grid.

In one or more embodiments, the coupler 1511 engages one or more threads 1607 disposed on the exterior surface of the head-receiving aperture 1606, which extend distally from the base member 1502 to retain the first base member portion 1508 against the second base member portion 1509 and the head 1605 of the hanger 1501 against the rail through the head-receiving aperture 1606.

The coupler 1511, moving toward the first half rail clamp 1512 and the second half rail clamp 1513 translates the head 1605 of the hanger 1501 toward the rail, thereby biasing and clamping the head 1605 against a major face of the rail. Thus, in one or more embodiments, the rail is clamped on three sides—two by the first base member portion 1508 and the second base member portion 1509, and a third by the head 1605 of the hanger 1501 against the major surface of the rail. Advantageously, a track hanger 1500 of FIGS. 15-20 comprises a uniquely configured base member 1502 that facilitates simple mounting and dismounting of the track hanger 1500 to a rail of a conventional suspension grid of a drop ceiling while also biasing the head 1605 of the hanger 1501 against the same rail for additional coupling power. Said differently, in one or more embodiments the head 1605 is insertable into the head receiver and the coupler 1511 is operable to engage an exterior surface of the head receiver to move the head 1605 through the head receiving aperture toward the first half rail clamp 1512 and the second half rail clamp 1513.

As noted above, in one or more embodiments each of the hanger 1501, the base member 1502, and the key 1503 are separable from each other. For example, in one embodiment the hanger 1501 can be detached from the base member 1502. Similarly, the key 1503 can be detached from the hanger 1501. As best shown in FIG. 16, in one or more embodiments the key 1503 can be detached from the distal end 1601 of the hook 1504. In this illustrative embodiment, the key 1503 is selectively attachable to the distal end 1601 of the hook 1504.

In one or more embodiments, to attach the key 1503 to the distal end 1601 of the hook 1504, the distal end 1601 of the hook 1504 opposite the extension 1505 of the hanger 1501 is inserted into a distal end receiver 1602 defined within a connector of the key 1503. In one or more embodiments, the distal end receiver 1602 is configured to frictionally retain the key 1503 to the distal end 1601 of the hook 1504. However, in other embodiments, a latch, snap, one-way latch, or other mating feature, such as engagement protrusion 1604, can be incorporated into either the distal end receiver 1602 or the distal end 1601 of the hook 1504 to engage an engagement recess 1603 or otherwise frictionally retain the key 1503 to the distal end 1601 of the hook 103.

Thus, in one or more embodiments the distal end receiver 1602 defines at least one engagement recess 1603. In one or more embodiments, the distal end 1601 of the hook 1504 comprises at least one engagement protrusion 1604 projecting from the distal end 1601. In one or more embodiments, the at least one engagement protrusion 1604 engages the engagement recess 1603 when the distal end 1601 is inserted into the distal end receiver 1602 to retain the key 1503 to the distal end 1601.

In this illustrative embodiment, a flat surface 1608 and the distal end 1601 of the hook 1504 mates with a corresponding flat surface 1609 of the distal end receiver 1602 to prevent rotation of the key 1503 about the distal end 1601 of the hook 1504. To wit, here the distal end receiver 1602 defines a corresponding flat surface 1609 and two arched protrusions. The distal end 1601 of the hook 1504 has a flat surface 1608 and two arched indentations that are complementary in shape to the two arched protrusions.

In one or more embodiments, when the distal end 1601 of the hook 1504 opposite the extension 1505 of the hanger 1501 is inserted into the distal end receiver 1602 of the key 1503, engagement of the two arched protrusions with the two arched indentations, opposite engagement of the complementary flat surface 1609 of the distal end receiver 1602 with the flat surface 1608 of the distal end 1601 of the hook 1504 prevents rotation of the key 1503 about the distal end 1601 of the hook 103.

Turning now to FIG. 20, illustrated therein are the first base member portion 1508 and the second base member portion 1509 after having been separated along the medial major axis 2010. This separation exposes the inner surfaces 2003,2004 of the first base member portion 1508 and the second base member portion 1509, respectively.

In one or more embodiments, the inner surface 2003 of the first base member portion 1508 comprises one or more bosses 2005,2006. Here, two bosses 2005,2006 are shown. However, more or fewer bosses can be included in other embodiments.

In this illustrative embodiment, the inner surface 2004 of the second base member portion 1509 comprises one or more boss receivers 2007,2008. Here, two boss receivers 2007,2008 are shown. However, more or fewer boss receivers can be included in other embodiments.

In one or more embodiments, the boss receivers 2007, 2008 comprise apertures that extend into the inner surface 2004 of the second base member portion 1509, and which have shapes that are complementary to the one or more bosses 2005,2006 of the inner surface 2003 of the first base member portion 1508. The one or more boss receivers 2007,2008 can optionally include wider mouths 2029,2030 at their openings to facilitate easier insertion of the one or more bosses 2005,2006 into the one or more boss receivers 2007,2008 when the first base member portion 1508 and the second base member portion 1509 are pressed together such that their inner surfaces 2003,2004 abut at the medial major axis 2010.

In one or more embodiments, when the first base member portion 1508 and the second base member portion 1509 are pressed together such that their inner surfaces 2003,2004 abut at the medial major axis 2010, the one or more bosses 2005,2006 insert into the one or more boss receivers 2007, 2008. This prevents the inner surfaces 2003,2004 of the first base member portion 1508 and the second base member portion 1509 from sliding about. Additional apertures 2011, 2012,2013,2014 can be tooled into the first base member portion 1508 and second base member portion 1509, respectively, to make each part lighter and to conserve material.

In the illustrative embodiment of FIG. 20, the base member (1502) includes a head receiver. In this illustrative embodiment, the first base member portion 1508 has a first half head receiver 2015 extending distally from a side of the first base member portion 1508 disposed opposite the first half rail clamp 1512. Similarly, the second base member portion 1509 has a second half head receiver 2016 extending distally from a side of the second base member portion 1509 disposed opposite the second half rail clamp 1513.

In this illustrative embodiment, the first half head receiver 2015 and the second half head receiver 2016 are both hemi-cylindrical. When the first base member portion 1508 and the second base member portion 1509 are pressed together such that their inner surfaces 2003,2004 abut at the medial major axis 2010, the edges of the first half head receiver 2015 and the second half head receiver 2016 also abut to define a cylindrical head receiver in this illustrative embodiment.

While a cylinder is one suitable shape for a head receiver formed by abutment of the edges of the first half head receiver 2015 and the second half head receiver 2016, other shapes can be used as well. In other embodiments, the head receiver is rectangular, triangular, polygonal, or free form shapes. Still other shapes for the head receiver will be obvious to those of ordinary skill in the art having the benefit of this disclosure.

In one or more embodiments, the inner surfaces 2017, 2018 of the first half head receiver 2015 and the second half head receiver 2016 define an interior socket to receive the head (1605) of a hanger (1501) configured in accordance with one or more embodiments of the disclosure. In one or more embodiments, the exterior surfaces 2019,2020 of the first half head receiver 2015 and the second half head receiver 2016 define one or more threads. When the first base member portion 1508 and the second base member portion 1509 are pressed together such that their inner surfaces 2003,2004 abut at the medial major axis 2010, the edges of the first half head receiver 2015 and the second half head receiver 2016 also abut to define a cylindrical head receiver having a an interior socket defined by the inner surfaces 2017,2018 of the first half head receiver 2015 and the second half head receiver 2016, and having threads defined by the exterior surfaces 2019,2020 of the first half head receiver 2015 and the second half head receiver 2016. The coupler (1511) can then be threaded onto the threads defined by the exterior surfaces 2019,2020 of the first half head receiver 2015 and the second half head receiver 2016 to couple the first base member portion 1508 and the second base member portion 1509 together.

In this illustrative embodiment, the first half head receiver 2015 defines a first half head-receiving aperture 2001. Similarly, the second half head receiver 2016 defines a second half head-receiving aperture 2002. In one or more embodiments, when coupling the first base member portion 1508 to the second base member portion 1509 causes the first half head receiver 2015 to abut the second half head receiver 2016, a head-receiving aperture (1606) is created into which the head (1605) of the hanger (1501) may situate.

When the head (1605) of the hanger (1501) is situated within the head-receiving aperture (1606), and the coupler (1511) is threaded onto the threads defined by the exterior surfaces 2019,2020 of the first half head receiver 2015 and the second half head receiver 2016 to couple the first base member portion 1508 and the second base member portion 1509 together, this causes the head (1605) of the hanger (1501) to advance toward the first half rail clamp 1512 and second half rail clamp 1513, respectively. When a rail is situated within the first half rail clamp 1512 and second half rail clamp 1513, this advancement of the head (1605) of the hanger (1501) toward the first half rail clamp 1512 and second half rail clamp 1513 causes the head (1605) of the hanger (1501) to "pinch" or "clamp" or "grab" the rail between the top of the head (1605) and the underside of the first half rail clamp 1512 and second half rail clamp 1513.

Figure 21:
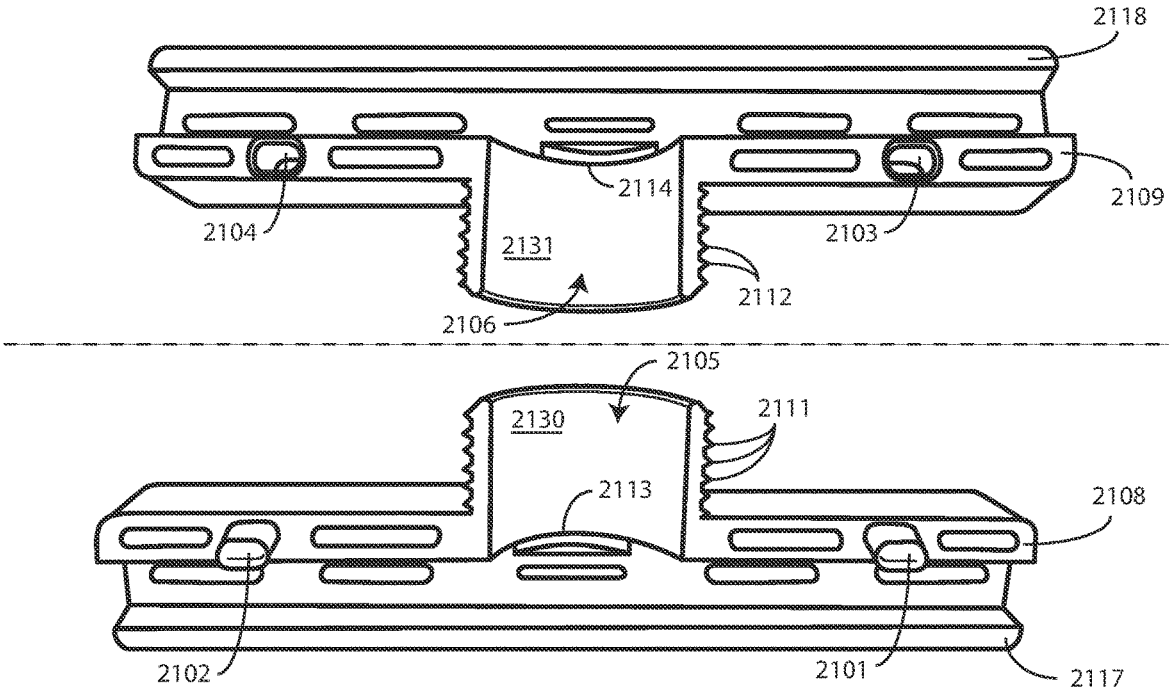
FIG. 21 illustrates yet another explanatory base member in accordance with one or more embodiments of the disclosure.

It should be noted that the first base member portion 1508 and the second base member portion 1509 can be configured in a variety of ways. Turning now to FIG. 21, illustrated therein is an alternate first base member portion 2108 and an alternate second base member portion 2109 configured in accordance with one or more embodiments of the disclosure.

As with the first base member portion (1508) and the second base member portion (1509) of FIG. 20, the alternate first base member portion 2108 and the alternate second base member portion 2109 of FIG. 21 include one or more bosses 2101,2102 and one or more boss receivers 2103,2104. The boss receivers 2103,2104 comprise apertures that extend into the inner surface of the second base member portion 2109 have shapes that are complementary to the one or more bosses 2101,2102 of the inner surface of the first base member portion 2108.

The base member of FIG. 21 also includes a head receiver. The first base member portion 2108 has a first half head receiver 2105 extending distally from a side of the first base member portion 2108 disposed opposite the first half rail clamp 2107, which is substantially wider than was the first half rail clamp (1512) of FIG. 20. Similarly, the second base member portion 2109 has a second half head receiver 2106 extending distally from a side of the second base member portion 2109 disposed opposite the second half rail clamp 2118, which is also substantially wider than the second half rail clamp (1513) of FIG. 20.

The inner surfaces 2130,2131 of the first half head receiver 2105 and the second half head receiver 2106 once again define an interior socket to receive the head (1605) of a hanger (1501). The exterior surfaces 2111,2112 of the first half head receiver 2105 and the second half head receiver 2106 again define one or more threads.

The first half head receiver 2105 defines a first half head-receiving aperture 2113. Similarly, the second half head receiver 2106 defines a second half head-receiving aperture 2114. In one or more embodiments, when coupling the first base member portion 2108 to the second base member portion 2109 causes the first half head receiver 2105 to abut the second half head receiver 2106, a head-receiving aperture (1606) is created into which the head (1605) of the hanger (1501) may situate.

Threading the coupler (1511) onto the threads defined by the exterior surfaces 2111,2112 of the first half head receiver 2105 and the second half head receiver 2106 then couples the first base member portion 2108 and the second base member portion 2109 together. It also causes the head (1605) of the hanger (1501) to advance toward the first half rail clamp 2107 and second half rail clamp 2118, respectively. When a rail is situated within the first half rail clamp 2107 and second half rail clamp 2118, this advancement of the head (1605) of the hanger (1501) toward the first half rail clamp 2107 and second half rail clamp 2118 causes the head (1605) of the hanger (1501) to clamp the rail between the top of the head (1605) and the underside of the first half rail clamp 2107 and second half rail clamp 2118.

Figure 22:
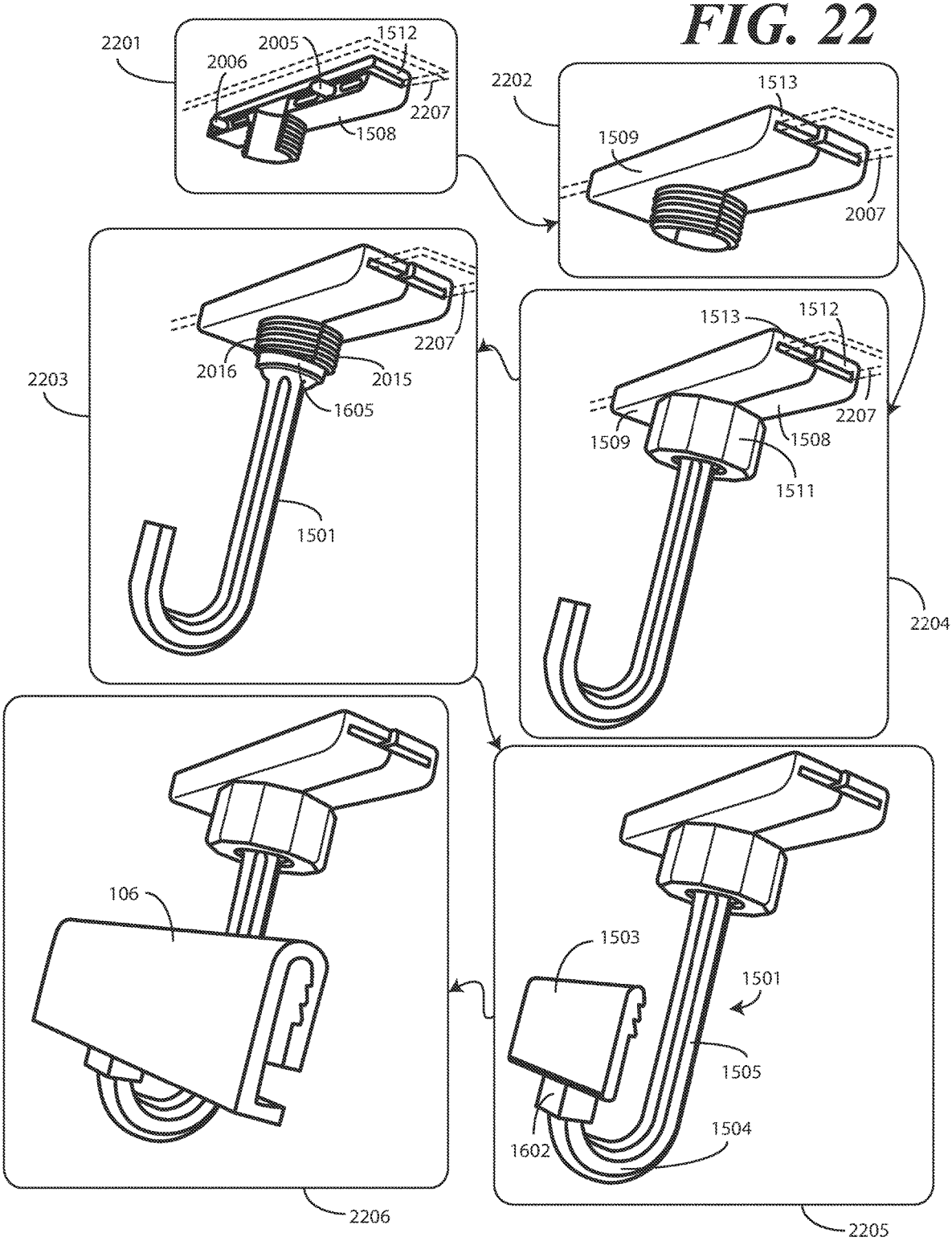
FIG. 22 illustrates one or more method steps for assembling another explanatory track hanger configured in accordance with one or more embodiments of the disclosure.

Turning now to FIG. 22, illustrated therein are one or more method steps in accordance with one or more embodiments of the disclosure. Beginning at step 2201, the first base member portion 1508 is positioned such that its first half rail clamp 1512 situates about a rail 2207. At step 2202, the second base member portion 1509 is positioned such that its second half rail clamp 1513 situates about the rail 2207. In one or more embodiments, this results in the one or more bosses 2005,2006 of the first base member portion 1508 inserting into the one or more boss receivers (2007,2008) of the second base member portion 1509 when the first base member portion 1508 and the second base member portion 1509 are pressed together such that their inner surfaces (2003,2004) abut at the medial major axis (2010). It also captures the rail 2207 between the first half rail clamp 1512 and the second half rail clamp 1513.

At step 2203, the head 1605 of the hanger 1501 is inserted into the head receiver formed by the first half head receiver 2015 extending distally from the bottom of the first base member portion 1508 and the second half head receiver 2016 extending distally from the bottom of the second base member portion 1509. In one or more embodiments, the head 1605 of the hanger 1501 is inserted into the head receiver until its upper surface abuts the rail 2207.

At step 2204, the coupler 1511 is threaded onto the threads defined by the exterior surfaces (2019,2020) of the first half head receiver 2015 and the second half head receiver 2016 to couple the first base member portion 1508 and the second base member portion 1509 together.

In this illustrative embodiment, the first half head receiver 2015 defines a first half head-receiving aperture (2001). Similarly, the second half head receiver 2016 defines a second half head-receiving aperture (2002). When the head 1605 of the hanger 1501 is situated within the head-receiving aperture 1606 created by the first half head-receiving aperture (2001) and second half head-receiving aperture (2002) abutting, threading the coupler 1511 is threaded onto the threads defined by the exterior surfaces (2019,2020) of the first half head receiver 2015 and the second half head receiver 2016 causes the head 1605 of the hanger (1501) to advance toward the rail 2207. This advancement of the head 1605 toward the rail 2207 causes the head 1605 to clamp the rail 2207 between the top of the head 1605 and the underside of the first half rail clamp 1512 and second half rail clamp 1513.

At step 2205, the key 1503 can be attached to the distal end (1601) of the hook 1504. In one or more embodiments, to attach the key 1503 to the distal end (1601) of the hook 1504, the distal end (1601) of the hook 1504 opposite the extension 1505 of the hanger 1501 is inserted into a distal end receiver 1602 defined within a connector of the key 1503. In one or more embodiments, the distal end receiver 1602 is configured with an engagement recess (1603) that receives an engagement protrusion (1604) projecting from a surface of the hook 1504. A flat surface (1608) and the distal end (1601) of the hook (1504) can mate with a corresponding flat surface (1609) of the distal end receiver 1602 to prevent rotation of the key 1503 about the distal end (1601) of the hook 1504. As step 2206, the track 106 can then be attached to the key 1503 as described above with reference to FIG. 10.

Figure 23:
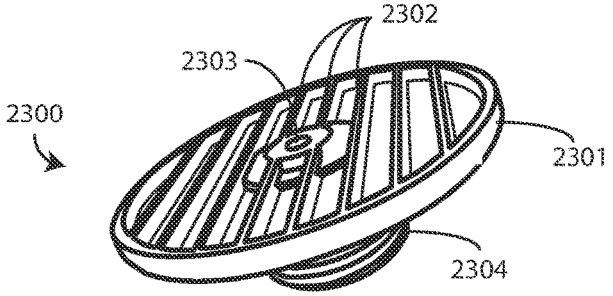
FIG. 23 illustrated one explanatory accessory suitable for use with one or more embodiments of the disclosure.

Turning now FIG. 23, illustrated therein is one explanatory accessory 2300 that can be used in place of the base member of FIGS. 15-22. In FIG. 23, the accessory 2300 is a screw adaptor base member.

In one or more embodiments, the accessory 2300 includes a circular attachment support 2301 that defines one or more recesses 2302 along its upper surface. An aperture 2303 is centrally disposed along the circular attachment support 2301. The aperture 2303 allows a screw or other fastener to be inserted from the lower surface of the circular attachment support 2301, through the aperture 2303, and out the upper surface of the circular attachment support 2301 to attach the accessory 2300 to a ceiling.

In one or more embodiments, a boss surrounds the aperture 2303 in a recess. A perimeter wall bounds the recesses 2302 in this illustrative embodiment. A head receiver 2304 includes one or more threads as previously described.

Figure 24:
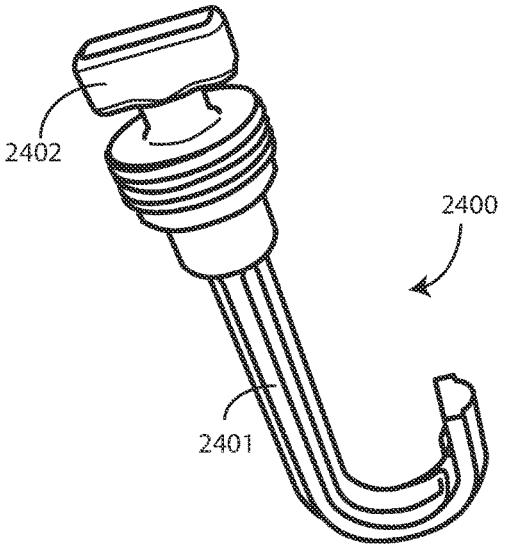
FIG. 24 illustrates another explanatory accessory suitable for use with one or more embodiments of the disclosure.

Turning now FIG. 24, illustrated therein is another explanatory accessory 2400 that can be used in place of the combined base member and hanger of FIGS. 15-22. In FIG. 23, the accessory 2400 is a combined hanger 2401 and rectangular track insertion head 2402. The rectangular track insertion head 2402 can be inserted into a track with the major axis of the rectangular track insertion head 2402 parallel to the major axis of the track. The accessory 2400 includes one or more threads as previously described.

Figure 25:
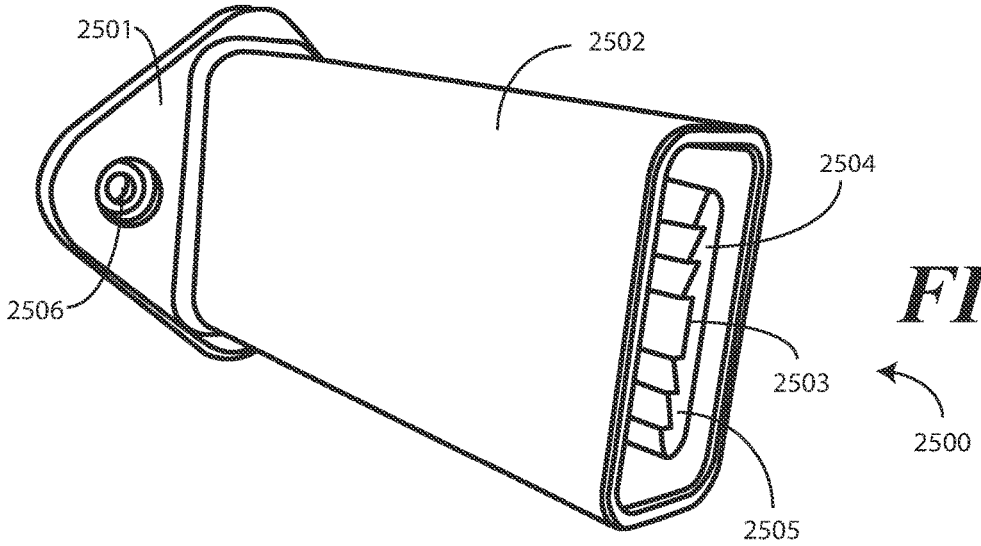
FIG. 25 illustrates yet another explanatory accessory suitable for use with one or more embodiments of the disclosure.

Turning now to FIG. 25, illustrated therein is another explanatory accessory 2500 configured in accordance with one or more embodiments of the disclosure. In FIG. 25, the accessory 2400 is an end cap for a track (106). In one or more embodiments, the end cap can be attached to a track (106), as shown above in FIGS. 1-4 and 11.

In this illustrative embodiment, the end cap includes a wall abutment 2501 and an extension 2502 that situates around the exterior of an end of the track (106). Situated within an interior of the extension 2502, along a center axis of the extension 2502, is a track insertion key 2503. In this illustrative embodiment, the track insertion key 2503 includes an upper track insertion key 2504 and a lower track insertion key 2505. In this embodiment, the lower track insertion key 2505 is a mirror image of the upper track insertion key 2504. This allows the accessory 2500 to be ambidextrous in that it can insert into the track (106) of FIG. 4 with either minor surface of the accessory 2500 situated on the top of the track (106). Thus, where the track (106) comprising one or more complementary barbs (405), as shown above in FIG. 4, the end cap can include a track insertion key 2505 that inserts into the one or more complementary barbs (405) regardless of whether the end cap is right side up or upside down.

In this illustrative embodiment, the wall abutment 2501 includes a quadrilateral attachment support that includes two apertures 2506 (with another being a mirror image of aperture 2506 similar to apertures 1153,1154 of FIG. 11). Screws can be inserted through the apertures 2506 to attach the quadrilateral attachment support to a wall. The track (106) can then be inserted into the extension 2502 around the track insertion key 2503 to securely adhere the track (106).

Figure 26:
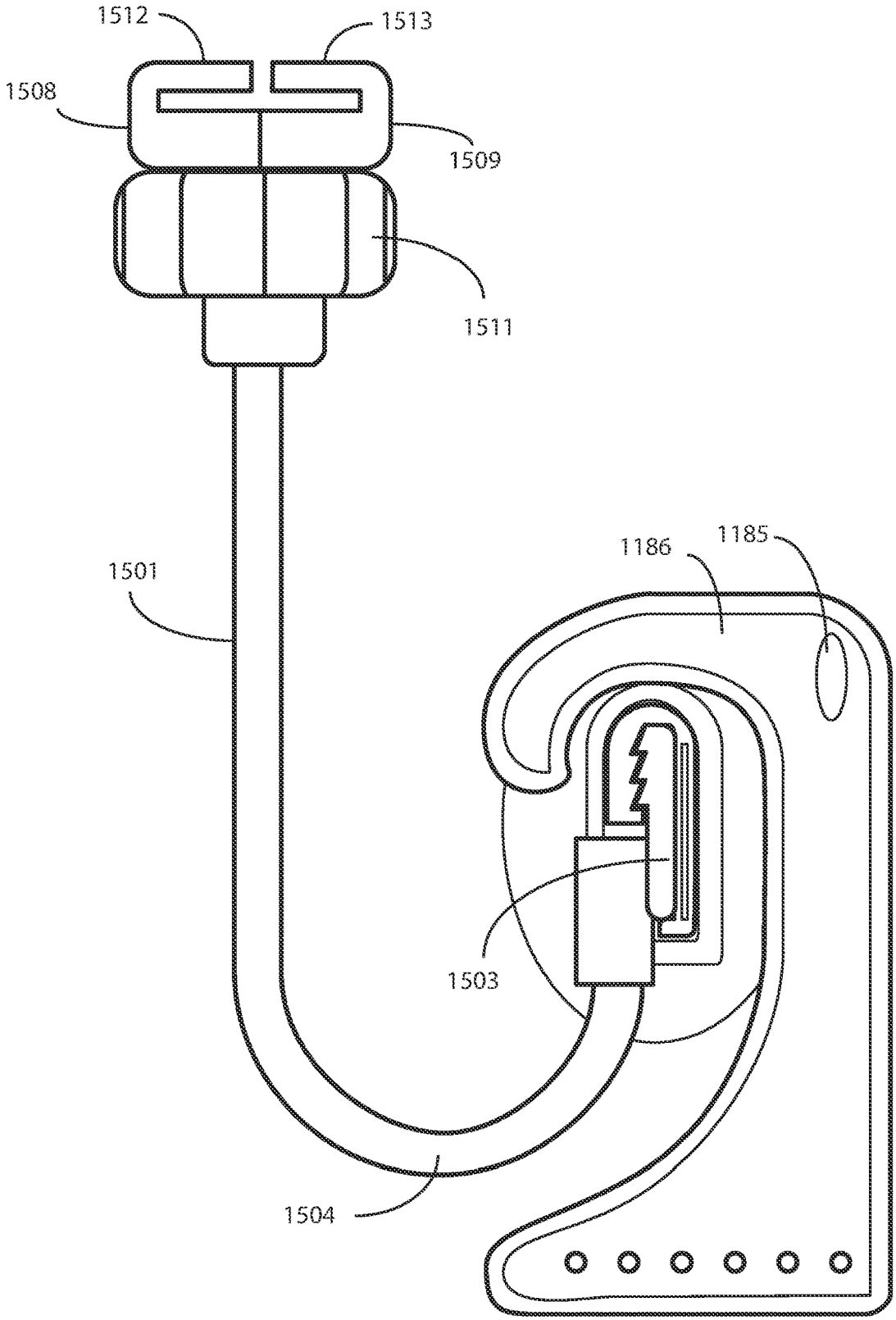
FIG. 26 illustrates one explanatory system in accordance with one or more embodiments of the disclosure.

Turning now to FIG. 26, illustrated therein is one explanatory assembled system 2600 in accordance with one or more embodiments of the disclosure. As shown in FIG. 26, the first base member portion 1508 is positioned such that its first half rail clamp 1512 situates about a rail 2207. The second base member portion 1509 is positioned such that its second half rail clamp 1513 situates about the rail 2207. The head (1605) of the hanger 1501 is inserted into the head receiver formed by the first half head receiver (2015) extending distally from the bottom of the first base member portion 1508 and the second half head receiver (2016) extending distally from the bottom of the second base member portion 1509 until its upper surface abuts the rail 2207.

The coupler 1511 is threaded onto the threads defined by the exterior surfaces (2019,2020) of the first half head receiver (2015) and the second half head receiver (2016) to couple the first base member portion 1508 and the second base member portion 1509 together. The key 1503 is attached to the distal end (1601) of the hook 1504. The track 106 is attached to the key 1503.

One or more hangers 1186 are then placed upon the track 106. The one or more hangers 1186 can be coupled to a curtain or other substrate, and can optionally include an aperture 1185 in its top corner.

Figure 27:
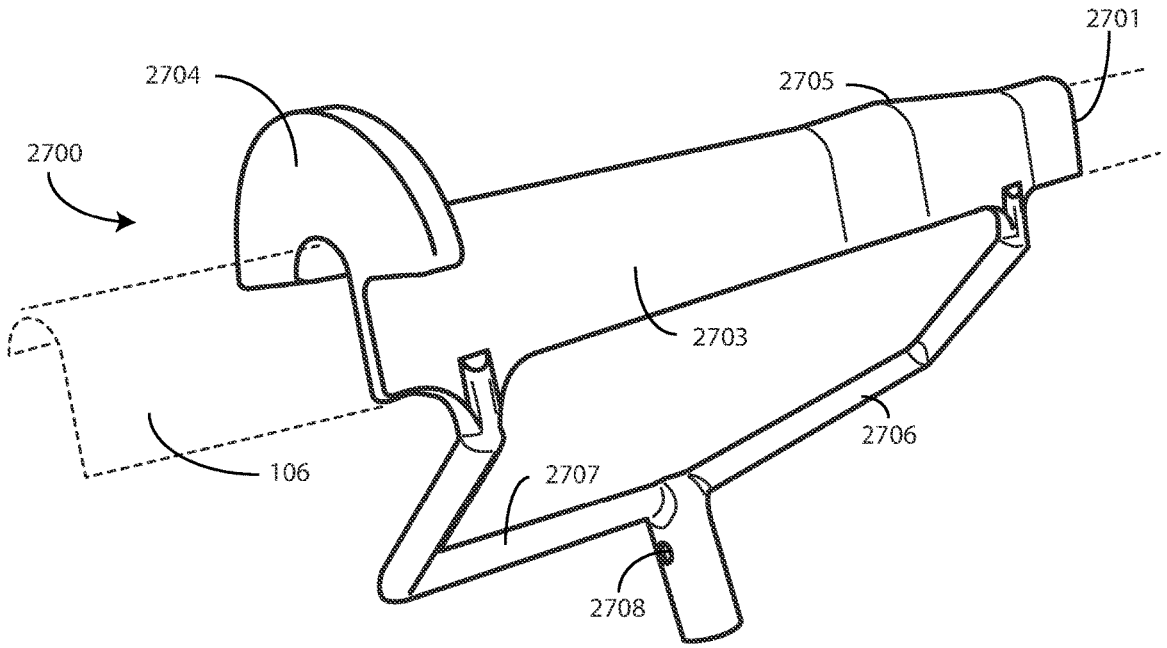
FIG. 27 illustrates a first perspective view of one explanatory hanger in accordance with one or more embodiments of the disclosure.
Figure 28:
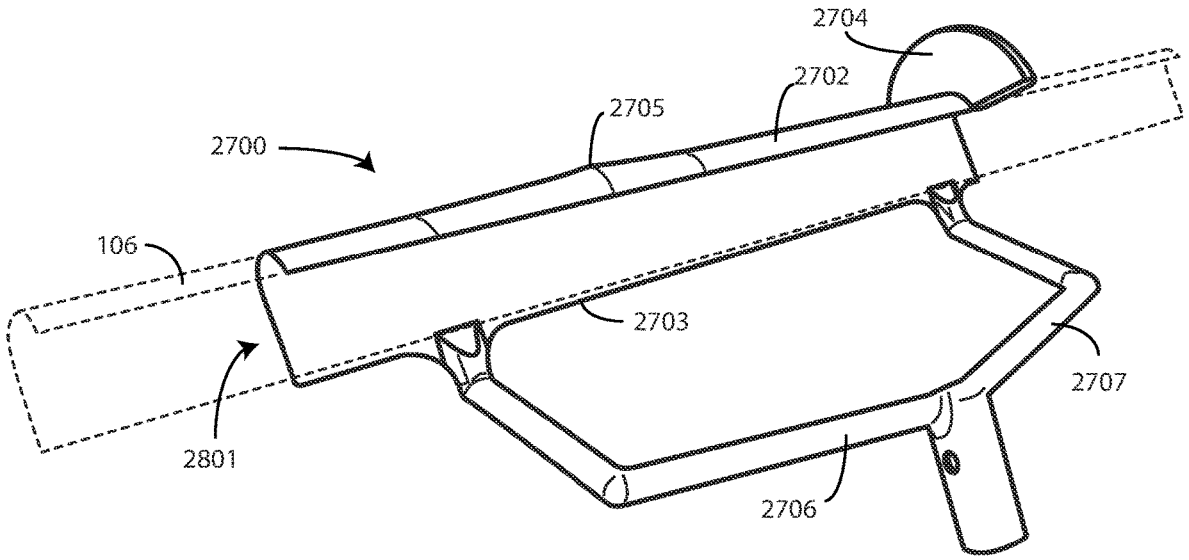
FIG. 28 illustrates another perspective view of one explanatory hanger in accordance with one or more embodiments of the disclosure.

Embodiments of the disclosure contemplate that it can be tedious to place each hanger 1186 upon the track 106, one by one, when there are many hangers 1186. To make this process easier, embodiments of the disclosure include an optional tool that allows a plurality of hangers 1186 to be quickly and easily placed upon the track 106. Turning now to FIGS. 27-28, illustrated therein is one such tool 2700. FIG. 27 shows a rear perspective view of the tool 2700, while FIG. 28 shows a front perspective view of the tool 2700.

The tool 2700 of FIGS. 27-28 includes a track grabber 2701 that extends along a major axis of the tool 2700. In one or more embodiments, the track grabber 2701 is configured as a half U-shape with an arch 2702 and a major face 2703 extending distally downward from the arch 2702 such that the end of the tool 2700 looks like a half-U with one upright missing.

In one or more embodiments, a hanger stop 2704 is situated at a first end of the track grabber 2701, while the other end of the track grabber 2701 is open, and includes no stop. The inclusion of the hanger stop 2074 provides a mechanical wall against which hangers will not slide off the track grabber 2701.

In one or more embodiments, the diameter of the arch 2702 of the track grabber 2701 gets larger at a resistance point 2705 that is located about seventy-five percent of the way down the length of the track grabber 2701 from the hanger stop 2704. The resistance point 2705 helps to retain hangers between the hanger stop 2704 and the resistance point 2705 until the arch 2702 of the track grabber 2701 is placed atop a track 106 and the tool 2700 is tipped toward the open end, i.e., the end of the track grabber 2701 opposite the hanger stop 2704, to a sufficient angle that any hangers situated along the track grabber 2701 slide over the resistance point 2705, off the track grabber 2701, and onto the track 106.

The tool 2700 of FIGS. 27-28 facilitates quick and easy mounting of hangers on a track 106 by allowing many hangers to be "scooped up" by the track grabber 2701 and placed between the hanger stop 2704 and the resistance point 2705. Thereafter, the tool 2700 can be placed such that the track grabber 2701 sits atop the track 106. The tool 2700 can be tipped, with the hanger stop 2704 situated above the open end of the track grabber 2701 such that the hanger stop 2704 is a sufficient distance away from the track 106 to allow gravity to cause the hangers to pass over the resistance point 2705 in one or more embodiments. In other embodiments, the hangers can be manually slid off the track grabber 2701 onto the track 106 without tipping. For example, where the hangers are attached to a curtain, a person can place the track grabber 2701 atop the track 106 and simply pull the curtain away from the hanger stop 2704 to slide the hangers over the resistance point 2705 and onto the track 106.

In one or more embodiments, the tool 2700 includes goal post arms 2706,2707 that can be attached to a shaft or pole so that the tool 2700 can be elevated to reach a track. In one or more embodiments, an internal snap protrusion can couple one or more apertures 2708 to one or more apertures of the shaft or pole.

Thus, as shown and described with reference to FIGS. 27-28, in one or more embodiments a track hanger configured in accordance with one or more embodiments of the disclosure includes a tool 2700. In one or more embodiments, the tool 2700 comprises a track grabber 2701. In one or more embodiments, the track grabber 2701 is situated atop the track 106. In one or more embodiments, the track grabber 2701 defines a half-U shape comprising an arch 2702 and a flat side extending distally from the arch 2702. In FIGS. 27-28, the flat side is shown as a major face 2703 of the track grabber 2701. In one or more embodiments, a diameter of the arch 2702 is wider at a resistance point 2705 of the track grabber 2701 than it is at other portions of the track grabber 2701 to retain hangers placed along the track grabber 2701 between the resistance point 2705 and the hanger stop 2704 until removal of the hangers from the tool 2700 is desired.

Figure 29:
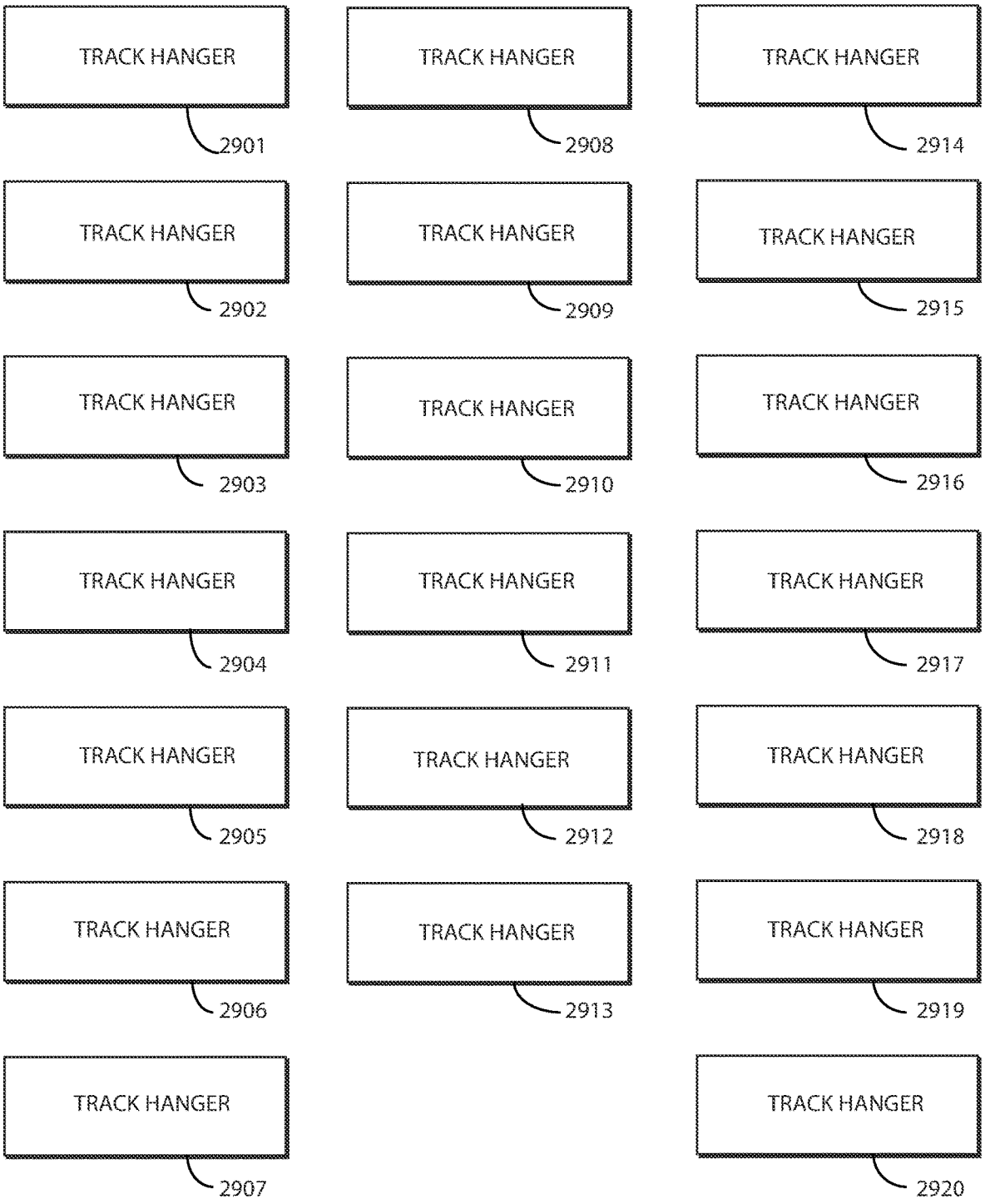
FIG. 29 illustrates various embodiments of the disclosure.

Turning now to FIG. 29, illustrated therein are various embodiments of the disclosure. At 2901, a track hanger comprises a first base member portion. At 2901, the first base member portion comprises a first half rail clamp. At 2901, the first base member defines a first half head-receiving aperture. At 2901, the track hanger comprises a second base member portion coupled to the first base member portion. At 2901, the second base member portion comprises a second half rail clamp and defining a second half head-receiving aperture.

At 2901, the track hanger comprises a hanger. At 2901, the hanger comprises an extension situated between a hook and a head. At 2901, the head is situated within the head-receiving aperture with an upper surface of the head exposed to the first half rail clamp and the second half rail clamp.

At 2901, the track hanger comprises a coupler. At 2901, the coupler couples the first base member portion to the second base member portion. At 2901, threading the coupler onto the first base member portion and the second base member portion moves the head of the hanger toward the first half rail clamp and the second half rail clamp.

At 2902, the track hanger of 2901 further comprises a rail situated between the first half rail clamp and the second half rail clamp. At 2903, the coupler of 2902 causes the head of the hanger to clamp onto the rail situated between the first half rail clamp and the second half rail clamp.

At 2904, the track hanger of 2901 further comprises a head receiver extending distally from the head-receiving aperture. At 2905, the both the head receiver and the head of 2904 are cylindrical. At 2905, the head-receiving aperture is circular.

At 2906, an exterior surface of the head receiver of 2905 defines one or more threads. At 2907, the track hanger of 2906 further comprises a key that is detachable from the hook. At 2908, the key of 2907 comprises a first major surface and a second major surface. At 2908, the first major surface defines one or more barbs.

At 2909, the first base member portion of 2908 comprises one or more bosses. At 2909, the second base member portion of 2908 comprises one or more boss receivers. At 2910, the one or more bosses of 2909 insert into the one or more boss receivers when the first base member portion and the second base member portion abut.

At 2911, the first base member portion of 2907 is separable from the second base member portion along a medial major axis. At 2912, the key of 2907 comprises a distal end receiver. At 2912, the hook comprises a distal end inserted into the distal end receiver.

At 2913, the distal end receiver of 2912 defines at least one engagement recess. At 2913, the distal end comprises at least one engagement protrusion. At 2913, the at least one engagement protrusion projects from the distal end and engages the engagement recess when the distal end is inserted into the distal end receiver to retain the key to the distal end.

At 2914, the track hanger of 2901 further comprises a tool. At 2914, the tool comprises a track grabber situated atop the track. At 2914, the track grabber defines a half-U shape comprising an arch and a major face. At 2915, the diameter of the arch of 2914 is wider at a resistance point of the track grabber than at other portions of the track grabber.

At 2916, a track hanger comprises a hook, a head, and an extension. At 2916, the extension is disposed between the head and the hook.

At 2916, the track hanger comprises a base member. At 2916, the base member comprises a first half rail clamp and a second half rail clamp. At 2916, the base member comprises a head receiver defining a head-receiving aperture. At 2916, the head-receiving aperture exposes the head to the first half rail clamp and the second half rail claim when the head is inserted into the head-receiving aperture.

At 2916, the track hanger comprises a key. At 2916, the key is selectively attachable to the hook. At 2916, the track hanger comprises a coupler. At 2916, the head is insertable into the head receiver. At 2916, the coupler is operable to engage an exterior surface of the head receiver to move the head through the head-receiving aperture toward the first half rail clamp and the second half rail clamp.

At 2917, the key of 2916 comprises a first major surface and a second major surface. AT 2917, the first major surface defines one or more barbs.

At 2918, the track hanger of 2917 further comprises a track. At 2918, the one or more barbs facilitate a one-way penetration of the key into the track.

At 2919, the track hanger of 2918 further comprises an end cap. At 2919, the end cap is attached to the track. At 2919, the end cap comprises a wall abutment and an extension that situates around an exterior end of the track. At 2919, the track comprises one or more complementary barbs. At 2919, the end cap further comprises a track insertion key inserted into the one or more complementary barbs. At 2920, the track hanger of 2919 further comprises comprising one or more hangers hanging from the track.

In the foregoing specification, specific embodiments of the present disclosure have been described. However, one of ordinary skill in the art appreciates that various modifications and changes can be made without departing from the scope of the present disclosure as set forth in the claims below. Thus, while preferred embodiments of the disclosure have been illustrated and described, it is clear that the disclosure is not so limited. Numerous modifications, changes, variations, substitutions, and equivalents will occur to those skilled in the art without departing from the spirit and scope of the present disclosure as defined by the following claims. Accordingly, the specification and figures are to be regarded in an illustrative rather than a restrictive sense, and all such modifications are intended to be included within the scope of present disclosure. The benefits, advantages, solutions to problems, and any element(s) that may cause any benefit, advantage, or solution to occur or become more pronounced are not to be construed as a critical, required, or essential features or elements of any or all the claims.

What is claimed is:

1. A track hanger, comprising:

a first base member portion comprising a first half rail clamp and defining a first half head-receiving aperture;

a second base member portion coupled to the first base member portion, the second base member portion comprising a second half rail clamp and defining a second half head-receiving aperture;

a hanger comprising an extension situated between a hook and a head, the head situated within a head-receiving aperture formed by the first half head-receiving aperture and the second half head-receiving aperture, with an upper surface of the head exposed to the first half rail clamp and the second half rail clamp; and a coupler coupling the first base member portion to the second base member portion;

wherein threading the coupler onto the first base member portion and the second base member portion moves the head of the hanger toward the first half rail clamp and the second half rail clamp.

2. The track hanger of claim 1, further comprising a rail situated between the first half rail clamp and the second half rail clamp.

3. The track hanger of claim 2, the coupler causing the head of the hanger to clamp onto the rail situated between the first half rail clamp and the second half rail clamp.

4. The track hanger of claim 1, further comprising a head receiver extending distally from the head-receiving aperture.

5. The track hanger of claim 4, wherein both the head receiver and the head are cylindrical, and the head-receiving aperture is circular.

6. The track hanger of claim 5, wherein an exterior surface of head receiver defines one or more threads.

7. The track hanger of claim 6, further comprising a key that is detachable from the hook.

8. The track hanger of claim 7, the key comprising a first major surface and a second major surface, the first major surface defining one or more barbs.

9. The track hanger of claim 8, the first base member portion comprising one or more bosses, the second base member portion comprising one or more boss receivers.

10. The track hanger of claim 9, the one or more bosses inserting into the one or more boss receivers when the first base member portion and the second base member portion abut.

11. The track hanger of claim 7, wherein the first base member portion is separable from the second base member portion along a medial major axis.

12. The track hanger of claim 7, the key comprising a distal end receiver, the hook comprising a distal end inserted into the distal end receiver.

13. The track hanger of claim 12, the distal end receiver defining at least one engagement recess, the distal end comprising at least one engagement protrusion projecting from the distal end and engaging the at least one engagement recess when the distal end is inserted into the distal end receiver to retain the key to the distal end.

14. The track hanger of claim 7, further comprising a track coupled to the key and a tool comprising a track grabber situated atop the track, the track grabber defining a half-U shape comprising an arch and a major face.

15. The track hanger of claim 14, wherein a diameter of the arch is wider at a resistance point of the track grabber than at other portions of the track grabber.

16. A track hanger, comprising:

a hook, a head, and an extension, the extension disposed between the head and the hook;

a base member comprising a first half rail clamp and a second half rail clamp, the base member comprising a head receiver defining a head-receiving aperture exposing the head to the first half rail clamp and the second half rail clamp when the head is inserted into the head-receiving aperture;

a key, the key being selectively attachable to the hook; and a coupler;

wherein the head is insertable into the head receiver and the coupler is operable to engage an exterior surface of the head receiver to move the head through the head-receiving aperture toward the first half rail clamp and the second half rail clamp.

17. The track hanger of claim 16, wherein the key comprises a first major surface and a second major surface, the first major surface defining one or more barbs.

18. The track hanger of claim 17, further comprising a track, the one or more barbs facilitating one-way penetration of the key into the track.

19. The track hanger of claim 18, further comprising an end cap attached to the track, the end cap comprising a wall abutment and an extension that situates around an exterior end of the track, the track comprising one or more complementary barbs, the end cap further comprising a track insertion key inserted into the one or more complementary barbs.

20. The track hanger of claim 19, further comprising one or more hangers hanging from the track.

* * * * *